US009863194B2

(12) United States Patent
Larkin

(10) Patent No.: US 9,863,194 B2
(45) Date of Patent: Jan. 9, 2018

(54) SYSTEM FOR MANIPULATING TUBULARS FOR SUBTERRANEAN OPERATIONS

(71) Applicant: Canrig Drilling Technology Ltd., Houston, TX (US)

(72) Inventor: Brendan Larkin, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 14/888,834

(22) PCT Filed: May 2, 2014

(86) PCT No.: PCT/US2014/036635

§ 371 (c)(1),
(2) Date: Nov. 3, 2015

(87) PCT Pub. No.: WO2014/179727

PCT Pub. Date: Nov. 6, 2014

(65) Prior Publication Data

US 2016/0076319 A1 Mar. 17, 2016

Related U.S. Application Data

(60) Provisional application No. 61/819,340, filed on May 3, 2013.

(51) Int. Cl.
*E21B 19/15* (2006.01)

(52) U.S. Cl.
CPC ..... *E21B 19/155* (2013.01)

(58) Field of Classification Search
CPC ..... E21B 19/20; E21B 19/155; E21B 19/14; E21B 19/002; E21B 19/143; E21B 19/15; B65G 1/0442; F16L 1/207
(Continued)

(56) References Cited

U.S. PATENT DOCUMENTS

RE24,907 E * 12/1960 Maydew ..... E21B 19/155 414/22.59
3,292,320 A * 12/1966 Laharty ..... A01G 23/003 414/23
(Continued)

FOREIGN PATENT DOCUMENTS

JP 2001287127 A 10/2001
WO 2006059910 A1 6/2006
(Continued)

OTHER PUBLICATIONS

International Search Report for Application No. PCT/US2014/036635, dated Sep. 12, 2014, 1 page.
(Continued)

*Primary Examiner* — Gregory Adams
(74) *Attorney, Agent, or Firm* — Enrique Abarca; Abel Law Group, LLP

(57) ABSTRACT

A system for manipulating tubulars for subterranean operations includes a remote-controlled tubular lift system (RCTLS) having an engagement head configured to engage a proximal end region of a tubular and change the position of the tubular from a substantially horizontal position to a substantially vertical position, wherein in the vertical position a longitudinal axis of the tubular has an angular variation with respect to a predetermined vertical axis of not greater than about 5 degrees.

20 Claims, 20 Drawing Sheets

(58) Field of Classification Search
USPC ..... 166/77.51, 77.52; 175/52, 85; 414/22.51–22.59, 22.61–22.62, 23, 414/331.18, 543, 544, 736, 745.3; 52/116; 89/1.802, 1.805
See application file for complete search history.

(56) References Cited

U.S. PATENT DOCUMENTS

| | | | | | |
|---|---|---|---|---|---|
| 3,294,185 | A * | 12/1966 | O'Neill | E21B 7/124 | 166/352 |
| 3,404,741 | A * | 10/1968 | Dogaru | E21B 19/20 | 166/77.53 |
| 3,477,527 | A * | 11/1969 | Koot | E21B 19/002 | 175/5 |
| 4,172,684 | A * | 10/1979 | Jenkins | E21B 19/14 | 175/85 |
| 4,202,653 | A * | 5/1980 | Moller | B65G 1/0442 | 414/22.57 |
| 4,405,022 | A * | 9/1983 | Will | E21B 19/20 | 175/52 |
| 4,458,768 | A * | 7/1984 | Boyadjieff | E21B 15/00 | 173/196 |
| 4,604,724 | A | 8/1986 | Shaginian et al. | | |
| 4,610,315 | A * | 9/1986 | Koga | E21B 19/20 | 175/203 |
| 4,715,761 | A | 12/1987 | Berry et al. | | |
| 4,791,997 | A * | 12/1988 | Krasnov | E21B 19/20 | 166/77.52 |
| 4,822,230 | A | 4/1989 | Slettedal | | |
| 4,832,552 | A * | 5/1989 | Skelly | E21B 3/02 | 173/164 |
| 4,834,604 | A | 5/1989 | Brittain et al. | | |
| 4,850,439 | A | 7/1989 | Lund | | |
| 4,854,400 | A | 8/1989 | Simpson | | |
| 5,127,790 | A * | 7/1992 | Teague | E21B 19/155 | 414/22.51 |
| 5,468,121 | A | 11/1995 | Stogner | | |
| 6,116,118 | A | 9/2000 | Wesch, Jr. | | |
| 6,220,607 | B1 | 4/2001 | Schneider et al. | | |
| 6,263,763 | B1 | 7/2001 | Feigel, Jr. et al. | | |
| 6,321,596 | B1 | 11/2001 | Newman | | |
| 6,976,540 | B2 | 12/2005 | Berry | | |
| 7,090,035 | B2 * | 8/2006 | Lesko | E21B 19/20 | 175/113 |
| 7,140,445 | B2 * | 11/2006 | Shahin | E21B 7/20 | 166/380 |
| 7,363,991 | B2 * | 4/2008 | Baer | E21B 19/14 | 175/85 |
| 7,431,550 | B2 * | 10/2008 | Thompson | E21B 19/155 | 175/85 |
| 7,540,338 | B2 * | 6/2009 | Belik | E21B 19/155 | 175/52 |
| 7,552,775 | B2 * | 6/2009 | Pietras | E21B 19/155 | 166/380 |
| 7,677,856 | B2 | 3/2010 | Standal | | |
| 7,699,122 | B2 * | 4/2010 | Eriksen | E21B 19/14 | 175/52 |
| 7,744,327 | B2 | 6/2010 | Lops et al. | | |
| 7,967,540 | B2 * | 6/2011 | Wright | E21B 19/155 | 166/377 |
| 8,011,426 | B1 | 9/2011 | Orgeron | | |
| 8,028,748 | B2 * | 10/2011 | Laitolais, Jr. | E21B 41/0021 | 166/77.51 |
| 8,186,455 | B2 * | 5/2012 | Childers | E21B 19/155 | 166/380 |
| 8,408,334 | B1 | 4/2013 | Orgeron | | |
| 2004/0103515 | A1 | 6/2004 | Penman et al. | | |
| 2005/0061548 | A1 | 3/2005 | Hooper et al. | | |
| 2005/0135902 | A1 * | 6/2005 | Spisak | E21B 19/00 | 414/22.51 |
| 2006/0113073 | A1 | 6/2006 | Wright et al. | | |
| 2006/0151215 | A1 | 7/2006 | Skogerbo | | |
| 2007/0017703 | A1 | 1/2007 | Belik | | |
| 2008/0202813 | A1 | 8/2008 | Anthony | | |
| 2008/0296065 | A1 | 12/2008 | Standal | | |
| 2009/0126941 | A1 * | 5/2009 | Laitolais, Jr. | E21B 41/0021 | 166/377 |
| 2009/0136327 | A1 | 5/2009 | Often et al. | | |
| 2010/0206562 | A1 | 8/2010 | Webb | | |
| 2011/0188973 | A1 * | 8/2011 | Baumler | E21B 19/15 | 414/22.57 |
| 2012/0170998 | A1 | 7/2012 | Orgeron | | |
| 2012/0211217 | A1 | 8/2012 | Boutwell, Jr. et al. | | |
| 2012/0217024 | A1 | 8/2012 | Childers et al. | | |

FOREIGN PATENT DOCUMENTS

| | | | |
|---|---|---|---|
| WO | 2014179727 | A1 | 11/2014 |
| WO | 2014179730 | A1 | 11/2014 |
| WO | 2014179740 | A1 | 11/2014 |
| WO | 2014179741 | A1 | 11/2014 |

OTHER PUBLICATIONS

International Search Report for Application No. PCT/US2014/036639, dated Sep. 15, 2014, 1 page.
International Search Report for Application No. PCT/US2014/036654, dated Sep. 30, 2014, 1 page.
International Search Report for Application No. PCT/US2014/036655, dated Sep. 16, 2014, 1 page.
Vertical Tubular Handling Mouseholes, EFC Group, www.efcgroup.net, 2 pages.

* cited by examiner

SYSTEM FOR MANIPULATING TUBULARS FOR SUBTERRANEAN OPERATIONS

TECHNICAL FIELD

The following is generally directed to a system for manipulating tubulars for subterranean operations, and more particularly, a system and method of managing tubulars.

BACKGROUND ART

Drilling for oil and gas with a rotary drilling rigs is being undertaken to increasingly greater depths both offshore and on land, and is an increasingly expensive operation given the demands to search for resources deeper into the earth, which translates into longer drilling time. In fact, it has been recently estimated that the costs to operate some rigs can exceed nearly half a million dollars per day. Thus a heavy emphasis is placed on procedures for reducing delays in the drilling operation.

Currently, one of the most regular delays in the drilling operation is the extension of the drill string. When a small part of the tubular string extends above the drilling deck, additional tubulars must be moved from a storage rack and connected with the upper end of the tubular string to continue drilling to greater depths. Today, top drive rotary systems are most often used in place of other, older technology (e.g., a rotary table to turn the drill string), because it allows the rig to utilize pre-assembled tubular stands. The creation and handling of tubular stands, independently of the drilling process, is a potentially important way to save time and money, since multiple strings of tubulars can be assembled offline which can cause less delays to the actual drilling operation.

Previous systems of handling tubulars and creating stands while conducting drilling operations have been described. See, for example, U.S. Pat. No. 4,850,439. However, such systems generally rely upon a hoist to lift the tubular and lack features to ensure the safety of the workers. Other systems utilized in manipulating tubulars have been disclosed in U.S. Pat. No. 6,976,540, U.S. Pat. No. 4,834,604, U.S. Pub. No. 2006/0151215, and U.S. Pat. No. 6,220,607. Generally, these handling systems, are heavy, costly, and consume a large amount of space. Moreover, these systems generally require significant human physical contact with the tubulars and lifting equipment at numerous times and locations, which can result in costly delay or possible injury. The alignment and transfer operations are lengthy and complex and the paths of the tubulars in the offline stand building are not fully restricted, which creates delay and safety hazards.

The industry continues to demand improvements in drilling technologies.

SUMMARY

According to a first aspect, a system for manipulating tubulars for subterranean operations includes a remote-controlled tubular lift system (RCTLS) comprising an engagement head configured to engage a proximal end region of a tubular and change the position of the tubular from a substantially horizontal position to a substantially vertical position, wherein in the substantially vertical position a longitudinal axis of the tubular has an angular variation with respect to a predetermined vertical axis of not greater than about 5 degrees. The proximal end region is spaced away from a center of gravity of the tubular by at least about 0.2(l), wherein l is a length of the tubular, such as at least about 0.25(l), at least about 0.3(l), at least about 0.35(l), at least about 0.4(l), or even at least about 0.42(l).

In yet another aspect, a system for manipulating tubulars for subterranean operations includes a remote-controlled tubular lift system (RCTLS) having an engagement head configured to grasp a proximal end region of a tubular and change the position of the tubular from a substantially horizontal position to a substantially vertical position and a stabilizer configured to engage the tubular and limit swinging motion of the tubular during the change of the position of the tubular from the substantially horizontal position to the substantially vertical position. The RCTLS can be part of a set-back area, such as a stand-building area of a rig, and more particularly, the RCTLS can be part of a jack-up rig.

For another aspect, a system for manipulating tubulars for subterranean operations includes a work zone comprising a remote-controlled tubular lift system (RCTLS), an operator zone spaced away from the work zone, the operator zone having an input module configured to control operation of the RCTLS including an engagement head configured to grasp a proximal end region of a tubular, wherein the proximal end region is spaced away from a center of gravity of the tubular by at least about 0.2(l), wherein l represents a length of the tubular, a stabilizer configured to engage a distal end region of the tubular opposite the proximal end region, wherein the distal end region is spaced away from a center of gravity of the tubular by at least about 0.2(l), and wherein the RCTLS is configured to change a position of the tubular from a substantially horizontal position to a substantially vertical position by manipulating the proximal end region and the distal end region of the tubular with the engagement head and the stabilizer.

The engagement head can be contained within the work zone, and an operator, positioned in an operator zone spaced away from the work zone, can be configured to control movement of the engagement head assembly (e.g., the engagement head) from the operator zone. The operator zone can have an input module configured to control the engagement head assembly, and the input module can include at least one device selected from the group consisting of a control column, a joystick, an analog device, a digital device, a potentiometer, a variable resistor, a gyroscope, and a combination thereof. In one instance, the RCTLS can be an automated system.

The proximal end region of the tubular can have a proximal engagement region, the proximal engagement region can have a tapered surface extending at an angle relative to a joint surface. The proximal engagement region can have a proximal engagement surface shaped for complementary engagement with a portion of the engagement head. The proximal engagement region can have a smaller diameter relative to a diameter of the tubular at proximal tool joint. The proximal end region can be disposed between a center of gravity of the tubular and a proximal tool joint defining a proximal terminating end of the tubular. In certain instances, the proximal end region can be a zip groove or a lift nipple.

The tubular can have a distal end region including a distal engagement region, and the distal engagement region can have a tapered surface extending at an angle relative to a joint surface, and more particularly, the distal engagement region can have a distal engagement surface shaped for complementary engagement with a portion of the stabilizer. The distal engagement region can have a smaller diameter relative to a diameter of the tubular at distal tool joint, and the distal end region can be disposed between a center of gravity of the tubular and a distal tool joint defining a distal terminating end of the tubular, and more particularly, the distal end region can include a zip groove or a lift nipple.

The tubular can have an aspect ratio, defined as a minimum outer diameter of the tubular compared to a length of the tubular, (e.g., minimum outer diameter:length) of at least about 1:2, such as at least about 1:5, at least about 1:8, at least about 1:10, or even at least about 1:15. The tubular can have a minimum outer diameter of at least about 4 inches, such as at least about 4.5 inches, at least about 5 inches, wherein the minimum outer diameter of the tubular is not greater than about 25 inches. The tubular can have a weight of at least about 100 kg, such as at least about 200 kg, at least about 300 kg. The tubular can be selected from the group of tubulars consisting of drillpipe, casing, drillcollar, and a combination thereof.

The engagement head of the engagement head assembly can have a complementary surface configured to engage a complementary surface at the proximal end region of the tubular, and particularly, the engagement head can be configured to grasp the tubular at the proximal end region. The engagement head can be a jaw having a first portion and a second portion, wherein at least one of the first portion and the second portion are moveable with respect to each other, and wherein the first portion and the second portion are configured to be in an open position and a closed position. In the closed position, the jaw can be configured to grasp the proximal end region of the tubular, wherein at least a portion of the first portion defines a complementary surface, and wherein at least a portion of the second portion defines a complementary surface.

The engagement head can be part of an engagement head assembly including the engagement head configured to be coupled to an engagement head tower, wherein the engagement head tower can be contained within the work zone. The engagement head can be configured to translate vertically along an engagement head axis, wherein the engagement head axis can be substantially parallel to a predetermined vertical axis, and wherein the engagement head can be configured to translate along an engagement head axis that can be substantially parallel to the longitudinal axis of the tubular in the vertical position. The engagement head can be configured to translate vertically along the engagement head tower, or the engagement head can be configured to simultaneously translate along the engagement head axis, or even rotate about a rotational axis to change the position of the tubular from a substantially horizontal position to a substantially vertical position. The engagement head can be translated along a single axis, such as along a single, fixed, vertical axis, along the engagement head tower, which can be fixed to a surface of the work zone. The engagement head may, in certain non-limiting circumstances, have limited to no horizontal or lateral motion on the engagement head tower. In some instances, the engagement head can be coupled to the engagement head tower and configured to translate horizontally relative to the engagement head tower. In yet other instances, the engagement head can be coupled to the engagement head tower and configured to translate laterally relative to the engagement tower.

The engagement head assembly can include a drive device selected from the group of devices consisting of a motor, a hydraulic device, a pneumatic device, a servomotor, a stepper motor, DC motor, AC motor, and a combination thereof, and the drive device is configured to allow engagement of the engagement head with the proximal end region of the tubular. The drive device can be configured to translate the engagement head on the engagement head tower in at least one direction such as the vertical direction, lateral direction, horizontal direction, and a combination thereof. The drive device can be configured to rotate the engagement head about a rotational axis.

The engagement head can be configured to adapt to tubulars of different diameters. The engagement head can have a jaw configured to grasp tubulars of different diameters. The engagement head can include at least one sensor configured to detect a size of a tubular, and further the engagement head may be configured to adapt to a size of a tubular, and more particularly, at least a portion of the engagement head changes dimension in response to a detected size of the tubular.

The engagement head can have at least one sensor configured to detect a force applied to a tubular, and more particularly, the engagement head can be configured to have selectable pressure settings, and still more particularly, the engagement head can have different pressure states based on at least one characteristics of a tubular. In certain instances, the engagement head can be configured to adapt to a force applied to a tubular based on a size of the tubular.

The engagement head can include a sensor configured to detect the location of the tubular relative to at least one surface of the engagement head. The engagement head can have at least one device selected from the group consisting of a transducer, an optical sensor, a mechanical sensor, a magnetic sensor, an encoder, and a combination thereof. The engagement head can include at least one device to detect and measure the pressure applied to a tubular.

The engagement head can be part of an engagement head assembly comprising the engagement head coupled to an engagement head tower, and the engagement head assembly can have at least one sensor configured to detect a position of the engagement head relative to a position on the engagement head tower, and may include at least one sensor to detect at least one of a rotational position of the engagement head, a vertical position of the engagement head, a horizontal position of the engagement head, a position of the tubular, an angular variation of the tubular, and a combination thereof.

The system can include a stabilizer configured to engage a distal end region of the tubular and reduce swinging motion of the distal end of the tubular during a change of position of the tubular from the substantially horizontal position to the substantially vertical position. The stabilizer can be configured to engage at least a portion of the tubular in the substantially horizontal position. The stabilizer can be configured to move the tubular to an initial position to be engaged with the engagement head. The stabilizer may be configured to engage a portion of the tubular and guide a distal end of the tubular during the change of position of the tubular from the substantially horizontal position to the substantially vertical position. The stabilizer can be disposed in the work zone. The stabilizer can be remote-controlled, and may be operated by at least one operator located in an operator zone outside of the work zone.

The stabilizer can be configured for movement in one direction along at least one axis including a vertical axis, a lateral axis, a horizontal axis, and a combination thereof. The stabilizer can be configured for complex movement in at least two directions along the vertical axis, the lateral axis, the horizontal axis, and a combination thereof. The stabilizer may be configured for rotation around at least one axis, including but not limited to the vertical axis, the lateral axis, the horizontal axis, and a combination thereof. The stabilizer can have a receiving surface configured to engage at least a portion of the tubular. The receiving surface can have a contour having a complementary shape to at least a portion of the exterior surface of the tubular, and particularly, the receiving surface can have an arcuate contour, including for example, a substantially concave curvature. The stabilizer can include a roller configured to rotate as the tubular translates over a surface of the roller. The roller can include a receiving surface configured to engage at least a portion of the tubular.

The stabilizer can include a stop bar configured to engage a portion of the tubular and maintain contact between the tubular and a receiving surface of the stabilizer. The stop bar can have a latch. The stop bar can be configured to be actuated between an open position and a closed position, and in the open position the stop bar is spaced apart from a surface of the tubular, and in the closed position the stop bar may be configured to be in contact with a surface of the tubular. The tubular can be disposed between a receiving surface and the stop bar during a movement of the stabilizer.

The system may also include at least one alignment element configured to engage a portion of the tubular in the substantially vertical position. The alignment element can be configured to engage and assist in maintaining a stabilized state of the tubular, wherein in the stabilized state the tubular has an angular variation of not greater than about 5 degrees between a predetermined vertical axis and a longitudinal axis of the tubular. The stabilized state may be maintained during translation of the tubular along the predetermined vertical axis. The alignment element can include at least one roller configured to rotate in response to translation of the tubular over a surface of at least one roller. The tubular can be disposed between rollers. The alignment element can be moveable between a first position and a second position, and in the first position the alignment element is disengaged with a surface of the tubular and in the second position the alignment element is engaged with a surface of the tubular.

The engagement head can be configured to translate the tubular in a vertical position along the predetermined vertical axis and maintain a stabilized state of the tubular with an angular variation of not greater than about 5 degrees during translation. Moreover, in the vertical position a longitudinal axis of the tubular can be in a stabilized state having an angular variation with respect to a predetermined vertical axis of not greater than about 5 degrees, such as not greater than about 4.5 degrees, not greater than about 4 degrees, not greater than about 3.5 degrees, not greater than about 3 degrees, not greater than about 2.8 degrees, not greater than about 2.6 degrees, not greater than about 2.4 degrees, not greater than about 2.2 degrees, not greater than about 2 degrees.34. The engagement head is configured to translate the tubular along the predetermined axis in a stabilized state having an angular variation of not greater than about 5 degrees, not greater than about 4.5 degrees, not greater than about 4 degrees, not greater than about 3.5 degrees, not greater than about 3 degrees, not greater than about 2.8 degrees, not greater than about 2.6 degrees, not greater than about 2.4 degrees, not greater than about 2.2 degrees, not greater than about 2 degrees.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION OF THE PREFERRED EMBODIMENT(S)

The following is directed to systems for manipulating tubulars for subterranean operations, including but not limited to drilling operations directed to resources such as natural gas and oil. The present embodiments include description of one or more components of a system that may be employed in various stand-building processes. The present embodiments may be utilized one land or on water. In certain instances, the components, systems, and processes described herein may be utilized in off-shore drilling operations, particularly on jack-up rigs that generally have limited space to conduct operations.

Figure 1A:
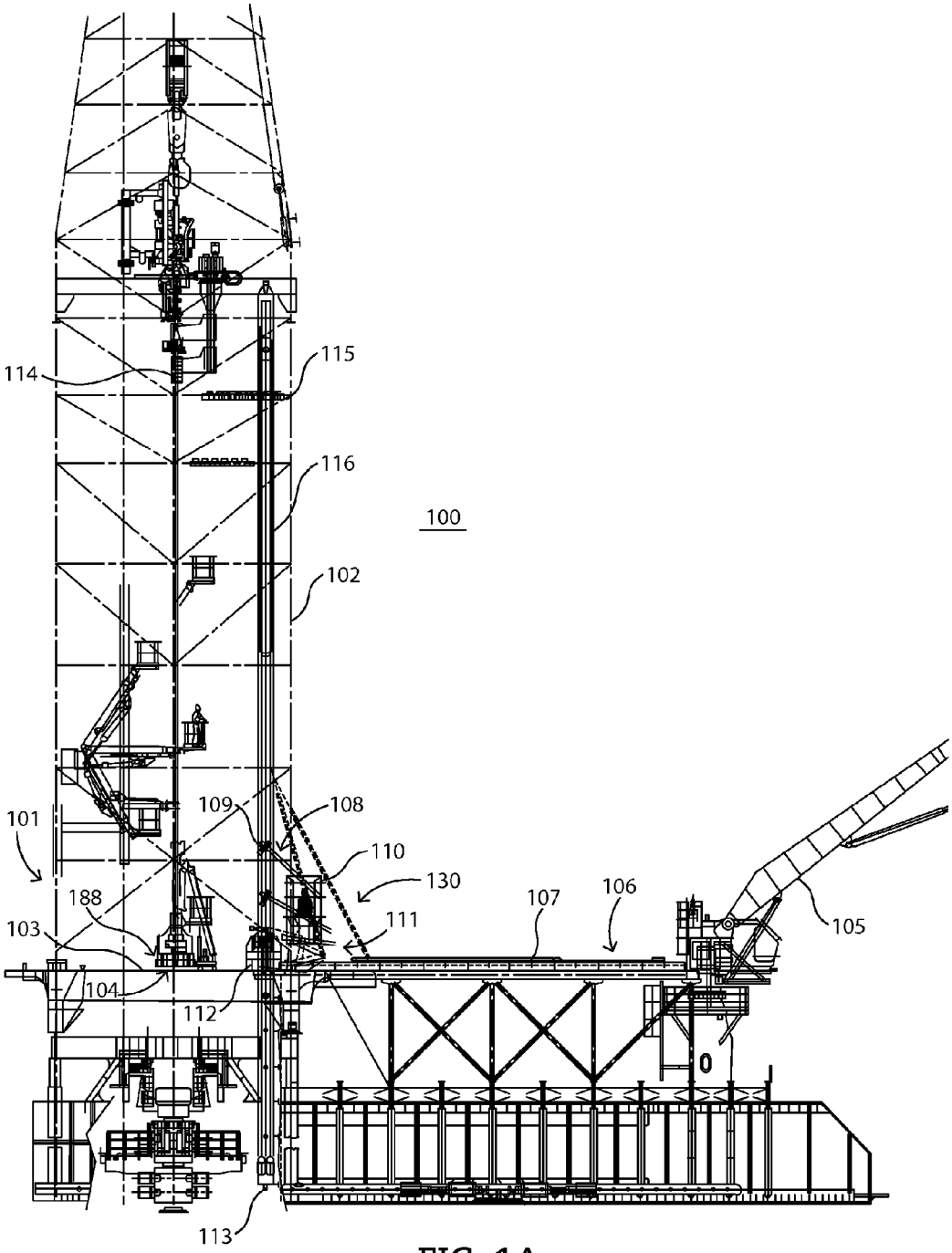
FIG. 1A includes a side view of a system for use in subterranean operations, including a tubular lift system in accordance with an embodiment.

FIG. 1A includes a side view of a system for manipulating tubulars for use in subterranean operations in accordance with an embodiment. In particular, the system 100 can include a derrick 101 extending from a drill floor 103 and configured to be a structure for supporting certain tools to conduct the subterranean operations. The drill floor 103 may be suspended above the earth as a structure to support the tools utilized in the drilling operation. As further illustrated, the system 100 can include a bore hole 104 or an opening in the drill floor 103 providing suitable access to the earth and natural materials beneath the earth's surface.

As further illustrated, the system 100 can include a pipe loader 105 that may be a machine configured to grab tubulars 107 from a storage location and place them on a pipe pusher 106. The pipe pusher 106 can be configured to move the tubular 107 from the pipe loader 105 to a tubular lift system 130 located on the drill floor 103. As illustrated, the tubular lift system 130 may be used to organize and combine one or more tubulars, and in particular, can be used in the formation of stands (i.e., a plurality of tubulars connected together). The tubular lift system 130 can be a remote-controlled tubular lift system (RCTLS). The tubular lift system 130 can include a stabilizer 111, which may be utilized to position the tubular 107 into an initial position for engagement with an engagement head 109.

The engagement head 109 may manipulate the tubular 107 from a substantially horizontal position to a substantially vertical position to facilitate forming a stand of tubulars which may be stored in a rack 115. The tubulars placed in the rack 115 may be later engaged and brought to well center 188 by a griphead 114 that may facilitate their use in the down hole, drilling operation. As further illustrated, the tubular lift system 130 may include an iron roughneck 112, which may be utilized to facilitate joining of the tubulars and formation of stands. Furthermore, the tubular lift system 130 may include an engagement head tower 108 along which an engagement head 109 may be translated to facilitate a change in position of the tubular 107 from a substantially horizontal position to a substantially vertical position. The tubular lift system 130 may include an operator cab 110 that is configured to house an operator controlling one or more of the components of the tubular lift system 130.

Figure 1B:
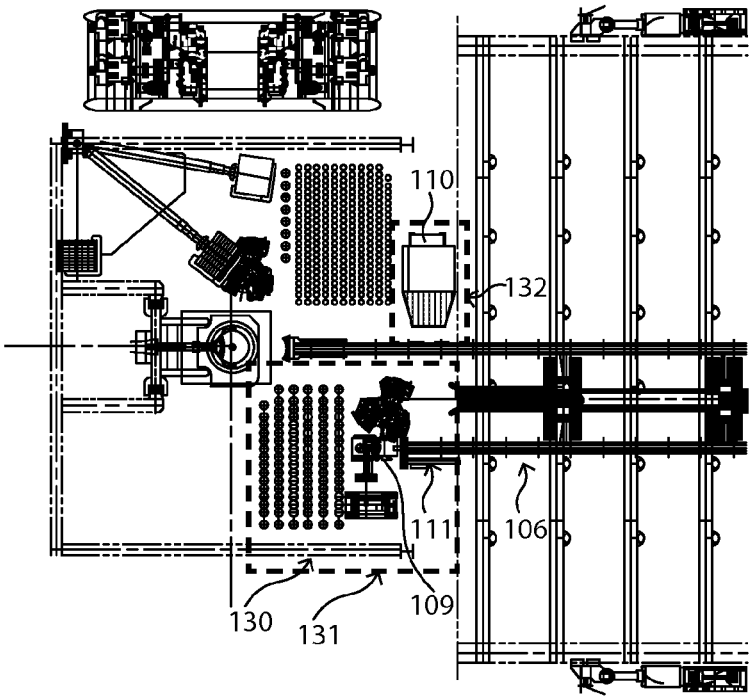
FIG. 1B includes a plan view of a system for use in subterranean operations, including a tubular lift system in accordance with an embodiment.

FIG. 1B includes a top view of a system for manipulation of tubulars for the subterranean operation in accordance with an embodiment. As further illustrated in the top view, the drill floor 103 can include a work zone 131, and the work zone 131 can include components of the tubular lift system 130, including but not limited to, the stabilizer 111, the mousehole assembly 113, the engagement head 109, the engagement head tower 108, and the iron roughneck 112. The drill floor 103 may further include an operator zone 132 spaced away from the work zone 131 and configured to house a controller or operator. The operator cab 110 can be disposed within the operator zone 132, and the operator can control movement of one or more components of the tubular lift system 130 from the operator zone 132. Furthermore, the operator zone 132 may include an input module configured to facilitate control of one or more components of the tubular lift system 130. Some exemplary input modules that may be utilized herein can include devices such as a control column, a joystick, an analog device, a digital device, a potentiometer, a variable resistor, a gyroscope, and a combination thereof.

In accordance with one particular embodiment, the tubular lift system 130 can be a remote-controlled operation, configured to allow an operator to be remotely located relative to the work zone 131. For example, any of the components of the tubular lift system 130 of the embodiments herein can be remote-controlled, and in particular, may be controlled by operation of one or more input modules to guide and control movement of the components by an operator in the operator zone 132 spaced apart from the work zone 131. The operator can be contained within an operator zone 132 and spaced away from the work zone 131, thus reducing the likelihood of injury to the operator. Moreover, any of the components or all of the components of the tubular lift system 130 may be fully automated, such that an entire stand-building operation can be controlled by actuation of a single switch.

Figure 2A:
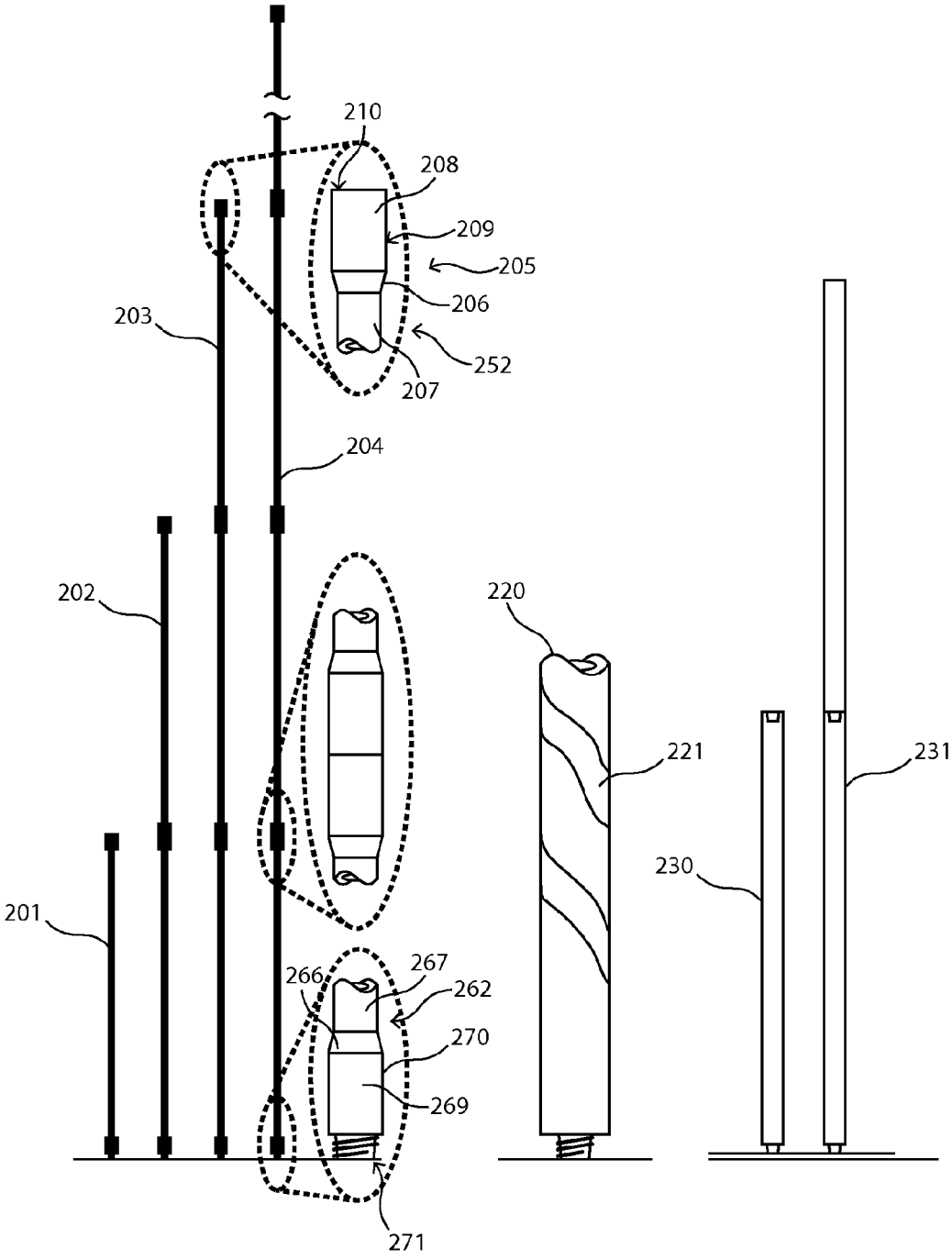
FIG. 2A includes illustrations of tubulars in accordance with an embodiment.

FIG. 2A includes an illustration of various tubulars that may be utilized with respect to the tubular lift system of the embodiments herein. The term "tubular" as used herein means all forms of pipe, including but not limited to, heavy weight drill pipe, such as HEVI-WATE™ tubulars, casing, drill collars, liner, bottom hole assemblies, and other types of tubulars known in the art. HEVI-WATE™ is a registered trademark of Smith International, Inc. of Houston, Tex. For example, some suitable tubulars can include drill pipes, including for example, a single drill pipe 201, which may have an average length of approximately 30 feet. Additionally, drill pipes may be joined together at a tool joint to form a double 202. Furthermore, multiple drill pipes including for example three or more drill pipes can be joined together to form a stand 203. In one particular embodiment, a combination of at least four drill pipes may be referred to as a fourble.

As further illustrated, the drill pipes can have a particular tool joint that may be utilized for joining two drill pipes together. For example, the tool joint 205 may include an enlarged end portion 208, commonly referred to as a box. The enlarged end portion 208 may be joined to a central portion 207 having a smaller external diameter connected by a tapered surface 206, which can define a portion of the proximal end region of the tubular. As will be further appreciated, joining of the pipes may be facilitated by a threaded engagement. Furthermore, one end of the tubular may have a female connection with a threaded surface extending into the interior of the tubular, while the opposite end of the tubular may have a male joint having a threaded portion extending from the interior of the tool joint.

Figure 2B:
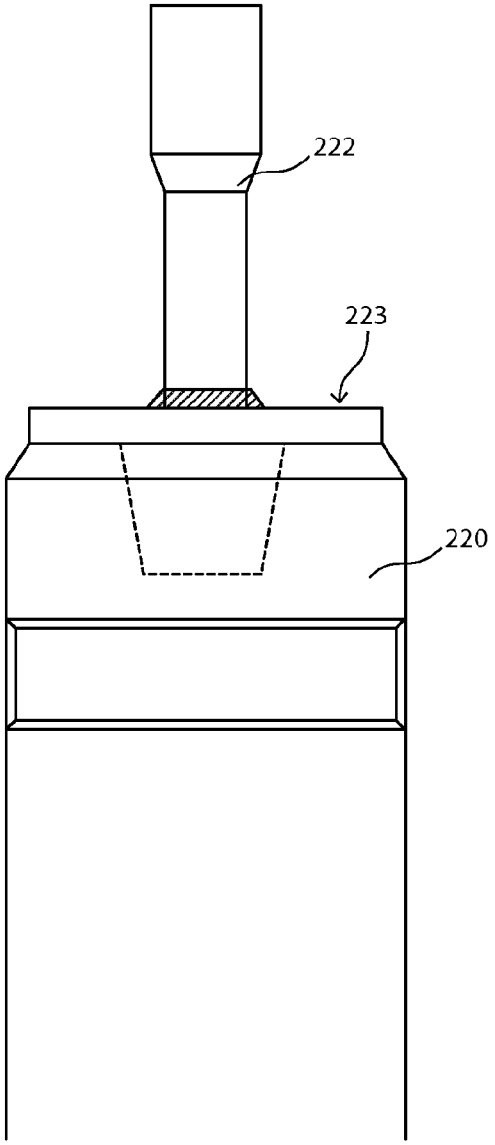
FIG. 2B includes an illustration of a portion of a tubular in accordance with an embodiment.
Figure 2C:
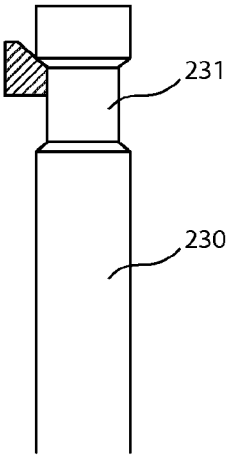
FIG. 2C includes an illustration of a portion of a tubular in accordance with an embodiment.
Figure 2D:
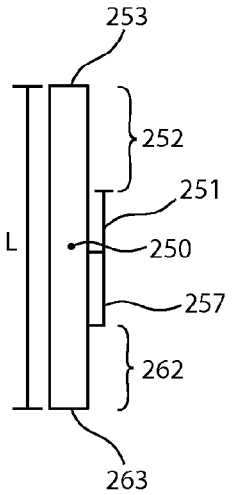
FIG. 2D includes an illustration of a tubular in accordance with an embodiment.

In accordance with one embodiment, a tubular may include a proximal end region that can be spaced away from a center of gravity of the tubular. In accordance with an embodiment, the proximal end region can be defined as a region that is spaced away from the center of gravity by at least about 0.2(l), wherein l is the length of the tubular. Referring briefly to FIG. 2D, an illustration of a tubular is provided. As illustrated, the tubular can include a center of gravity 250 and a length 1. As further illustrated, the tubular can include a proximal end region 252, which is spaced a distance 251 from the center of gravity 250 of the tubular. The distance 251 can be at least 0.2(l) away from the center of gravity 250. In other embodiments, the proximal end region 252 can be spaced a distance 251 from the center of gravity, including for example at least about 0.25(l), at least about 0.3(l), at least about 0.35(l), at least about 0.4(l), or even at least about 0.42(l). Still, it will be appreciated that in certain instances, the proximal end region 252 may be spaced apart from and non-intersecting a proximal terminating end 253 of the tubular, such that the distance 251 is not greater than about 0.5(l), not greater than about 0.49(l), or even not greater than about 0.48(l). It will be appreciated that the distance 251 can be within a range between any of the minimum and maximum values noted above.

As further illustrated in FIG. 2D, the tubular can have a distal end region 262 spaced a distance 257 from the center of gravity 250. According to one embodiment, the distance 257 can be at least 0.2(l) away from the center of gravity 250. In other embodiments, the distal end region 262 can be spaced a distance 257 from the center of gravity 250 of at least about 0.25 (l), at least about 0.3 (l), at least about 0.35 (l), at least about 0.4 (l), or even at least about 0.42 (l). Still, it will be appreciated that in certain instances, the distal end region 262 may be spaced apart from and non-intersecting a distal terminating end 263 of the tubular, such that the distance 257 is not greater than about 0.5(l), not greater than about 0.49(l), or even not greater than about 0.48(l). It will be appreciated that the distance 257 can be within a range between any of the minimum and maximum values noted above.

Referring again to FIG. 2A, the proximal end region 252 of a tubular may include a proximal engagement region having a proximal engagement surface shaped for complimentary engagement with a portion of the engagement head 109. For at least one embodiment, the proximal engagement region may include a region of the tubular having a smaller diameter relative to a diameter of the tubular at a proximal tool joint 205. For example, the central portion 207 and the tapered surface 206, which are adjacent the enlarged end portion 208, may define a proximal engagement surface and facilitate complementary engagement with portions of the engagement head 109.

Other types of tubulars, as provided in FIG. 2A can include a drill collar 220. In one instance, the drill collar 220 may have a fluted surface 221, which may have particular uses in certain subterranean operations. Referring briefly to FIG. 2B, a portion of a drill collar 220 is illustrated. In particular, a proximal end region of the drill collar 220 can include a lift nipple 222 extending from a terminating end 223 of the drill collar 220. In certain instances, the proximal end region of the drill collar 220 may include the lift nipple 222, which may be configured to be engaged with the engagement head 109 to facilitate changing the position of the drill collar 220 from a substantially horizontal position to a substantially vertical position.

Referring again to FIG. 2A, another type of tubular can be casing 230. As illustrated, the casing 230 may be generally a cylindrical shape with a smooth exterior surface. Referring briefly to FIG. 2C, a proximal end region of a casing 230 is illustrated. In accordance with an embodiment the casing 230 can have a proximal end region including a zip groove 231 which may facilitate engagement of the proximal end region of the casing 230 with the engagement head 109 and a change of position of the casing 230 from a substantially horizontal position to a substantially vertical position.

In accordance with another embodiment, any of the tubulars described herein can have a distal end region 262 displaced a distance from the proximal end region 252, and more particularly, may be positioned at or near the opposite end of the tubular from the proximal end region 252. It will be appreciated that the distal end region 262 can include any of the features of the proximal end region 252. For example, the distal end region 262 may include a distal engagement region 267 that may include a feature such as a tapered surface 266 extending at an angle relative to a joint surface 269.

Additionally, or alternatively, the distal engagement region 267 can include a distal engagement surface that is shaped for complementary engagement with a portion of a stabilizer 111. The distal end engagement region 267 can have a diameter that can be smaller than the diameter of the tubular at the distal terminating end. Moreover, as described herein with respect to the proximal engagement region, the distal end region may include a zip groove, a lift nipple, and the like. As illustrated herein, the distal end region 262 of the tubular can include a distal tool joint 270, which may include a threaded surface for engagement with another end of a tubular.

The tubulars of embodiments herein may have a particular aspect ratio, as measured by the minimum outer diameter to the length (minimum outer diameter:length) of the tubular. In accordance with an embodiment, the tubulars herein can have an aspect ratio of at least about 1:2, such as at least about 1:5, at least about 1:8, at least about 1:10, or even at least about 1:15.

The tubulars of the embodiments herein can have various sizes depending upon their intended purpose. For example, the tubulars herein may have a minimum outer diameter of at least about 4 inches, such as at least about 4.5 inches, at least about 5 inches, or even at least about 6 inches. Still, the tubulars of the embodiments herein may have a minimum outer diameter that is not greater than about 25 inches, such as not greater than about 20 inches, not greater than about 15 inches, or even not greater than about 12 inches.

Furthermore, it will be appreciated that the size and weight of tubulars herein is significant. For example, the tubulars may have a weight of at least about 100 kg, such as at least about 200 kg, at least about 300 kg.

ENGAGEMENT HEAD ASSEMBLY AND A MOUSEHOLE ASSEMBLY

Figure 3A:
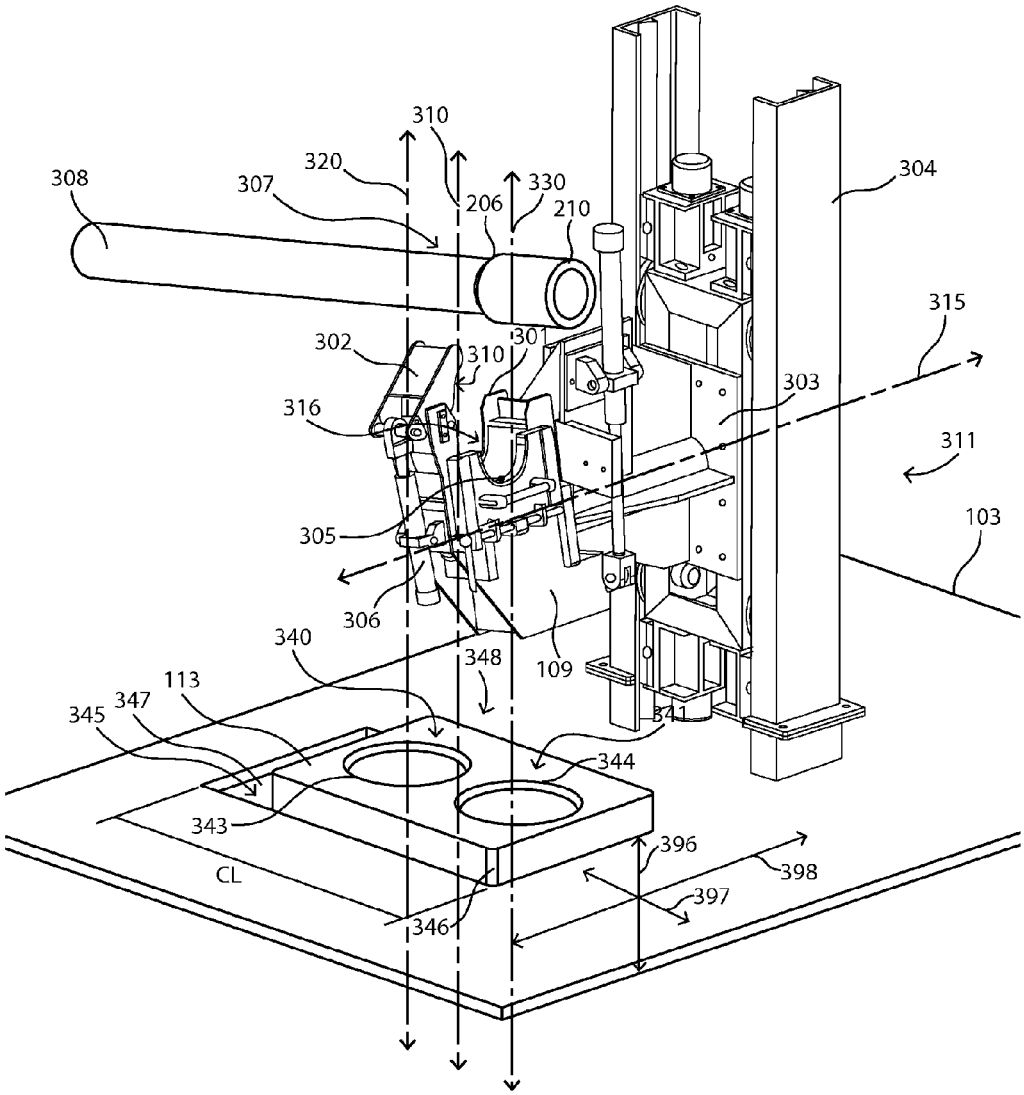
FIGS. 3A-3F include perspective view illustrations of an engagement head and mousehole assembly in accordance with embodiments.

FIGS. 3A-3F include perspective view illustrations of certain components used in the tubular lift system 130 of the embodiments herein. Other components, such as the stabilizer 111 and alignment elements, which are also part of the tubular lift system 130 may be described in more detail in another section herein. FIG. 3A includes a perspective view illustration of an engagement head assembly 311 and mousehole assembly 113 in accordance with an embodiment. As illustrated, the engagement head assembly 311 can include an engagement head 109 coupled to an engagement head tower 304 via a carriage 303. The engagement head 109 can be positioned below a tubular 308 provided a substantially horizontal position.

It will be appreciated that the engagement head assembly 311 can be contained within the work zone 131 on the drill floor 103. Furthermore, it will be appreciated that the engagement head tower 304, which is part of the engagement head assembly 311, can be contained with the work zone 131 on the drill floor 103. In one embodiment, the engagement head assembly 311 can include rails extending vertically from the drill floor 103 providing a pathway for movement of the engagement head 109. The carriage of 303 of the engagement head assembly 311 can be configured to couple the engagement head 109 with the engagement head tower 304 and further facilitate translating of the engagement head 109 along the engagement head tower 304.

Figure 3B:
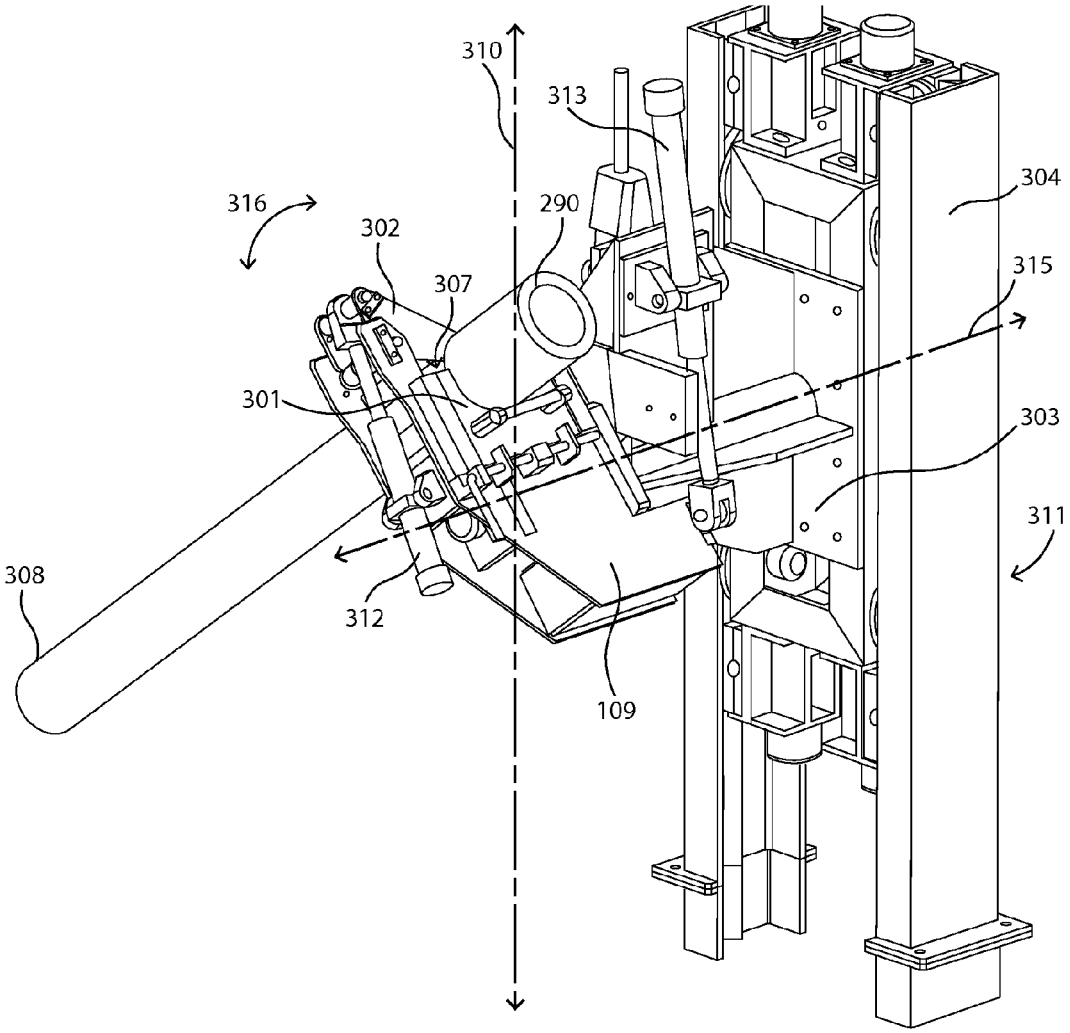

The engagement head 109 can include a first portion 301 and a second portion 302, which may be movable with respect to each other. For example, in one embodiment, the first portion 301 may be configured to move relative to the second portion 302. Still in other embodiments, the first portion 301 may be stationary and the second portion 302 may be configured to move relative to the first portion 301. As illustrated, the engagement head 109 may be in the form of a jaw including the first portion 301 and second portion 302, which can move with respect to each other from an open position to a closed position. In the open position, such as illustrated in FIG. 3A, the second portion 302 can be spaced apart from the first portion 301 and configured to engage a proximal end region 307 of the tubular 308. The first portion 301 and second portion 302 can be moved relative to each other to a closed position, such as illustrated in FIG. 3B. Notably, in the closed position, the first portion 301 and the second portion 302 of the engagement head 109 may be configured to grasp the proximal end region 307 of the tubular 308.

In at least one embodiment, the first portion 301 of the engagement head 109 may have a complementary surface having a shape configured to engage at least a portion of the proximal end region 307 of the tubular 308. For example, as illustrated in FIG. 3A, the first portion 301 can include a generally arcuate surface configured for complementary engagement of the cylindrical surface of the proximal end region 307 of the tubular 308. Furthermore, the engagement head 109 can include a second portion 302 having a surface 310 configured to engage a portion of the proximal end region 307 of the tubular 308. In particular instances, the surface 310 of the second portion 302 may be shaped for complementary engagement with at least a portion of the surface of the proximal end region 307 of the tubular 308. For example, as illustrated in FIG. 3A, the surface 310 may have at least a generally arcuate surface configured for engagement with at least a portion of the exterior surface of the proximal end region 307 of the tubular 308.

The engagement head 109 can be configured to translate vertically along an engagement head axis 310. It will be appreciated that certain directions described herein can be defined with respect to a plane generally defined by the drill floor 103. For example, a vertical axis can be defined by the vertical direction 396 extending perpendicular to the plane of the drill floor 103. A horizontal axis can be defined by the horizontal direction 397 extending in a direction parallel to the drill floor 103. The lateral axis can be defined by a lateral direction 398 can extend perpendicular to the vertical direction 396 and perpendicular to the horizontal direction 397. As further illustrated, the combination of the lateral direction 396 and horizontal direction 397 can define a plane that is substantially parallel with the drill floor 103.

It is noted herein, the engagement head 109 can be configured to translate vertically along an engagement head axis 310 which may be substantially parallel to a predetermined vertical axis. The predetermined vertical axis can extend in the vertical direction 396 and is an identified axis providing suitable alignment between one or more components and facilitating suitable stand-building operations. In particular instances, the engagement head axis 310 can be the same as the predetermined vertical axis. In other embodiments, the engagement head axis 310 can be spaced apart from the predetermined vertical axis. The engagement head 109 can be configured to translate along the engagement head axis 310, which can further be substantially parallel to a longitudinal axis of a tubular in the substantially vertical position.

In accordance with an embodiment, the engagement head assembly 311 can include at least one drive device selected from the group of devices consisting of a motor, a hydraulic device, a pneumatic device, a stepper motor, a servo motor, DC motor, AC motor, and a combination thereof. The drive device can be configured to allow for movement of one or more components of the engagement head assembly 311, including for example, but not limited to movement of the engagement head 109 for engagement with a proximal end 307 of the tubular 308. In still other instances, the drive device may be configured to translate the engagement head 109 on the engagement head tower 304, and more particularly, vertically translate the engagement head 109 along the engagement head axis 310 along the engagement head tower 304. Furthermore, at least one drive device may be utilized to facilitate rotation of the engagement head 109 relative around a rotational axis 315. While the rotational axis 315 is shown as extending generally in the lateral direction 398, it will be appreciated that the rotational axis 315 can extend in any direction, including the vertical axis 396, the horizontal axis 397, the lateral axis 396, and any axis in between.

FIG. 3B includes a perspective view illustration of an engagement head assembly engaged with a tubular in accordance with an embodiment. In particular, the engagement head 109 is in a closed position and the second portion 302 of the engagement head 109 can be grasping and engaged with the proximal end region 307 of the tubular 308. Furthermore, as illustrated the engagement head 109 is illustrated as translating in a vertical direction 396 along the engagement head axis 310. Moreover, the engagement head 109 has rotated around the rotational axis 315 to facilitate an initial change of position of the tubular 308 from a substantially horizontal position as illustrated in FIG. 3A to a substantially vertical position. As illustrated, the engagement head 109 can be in a closed position.

According to one embodiment, the engagement head 109 can include a drive device 312 that facilitates relative movement of the second portion 302 to the first portion 301 of the engagement head 109. In particular instances, the drive device 312 can be a pneumatic device or hydraulic device configured to translate linear motion to a rotational motion of the second portion 302 and facilitate movement of the second portion 302 between an open position and a closed position. It will be appreciated that other drive devices may be utilized to achieve relative motion between the first portion 301 and the second portion 302.

The engagement head assembly 311 can include a carriage 303 including a drive device 313. The drive device 313 can include a hydraulic or pneumatic device configured to translate linearly and convert the linear motion of the drive device to rotary motion of the engagement head 109 around a rotational axis 315. As noted herein, the rotational axis 315 may correspond to a generally lateral direction 398. As shown in FIG. 3B, the engagement head 109 can be configured to rotate in a direction 316 about the rotational axis 315. It will be appreciated that other drive devices may be utilized to achieve relative rotational motion of the engagement head 109.

While not illustrated, it will be appreciated that certain designs of the engagement head 109 may allow for translation of the engagement head 109 in a horizontal direction 397 relative to the engagement head tower 304. In other embodiments, while not illustrated, it will be appreciated that the engagement head 109 can be coupled to the engagement head tower 304 and configured to translate in a lateral direction 396 relative to the engagement tower 304. Still, in at least one non-limiting embodiment, the engagement head 109 may be configured to translate in a single direction, and more particularly, in a fixed vertical direction 396 along the engagement head axis 310. Accordingly, in such instances, the engagement head 109 may have limited ability to translate in a horizontal direction 397 or a lateral direction 398.

In accordance with an embodiment, the engagement head 109 can include a sensor 305 that may be configured to detect certain aspects of the tube lifting process. Reference herein to a sensor can include a device such as a transducer, an optical sensor, a mechanical sensor, a magnetic sensor, an encoder, and a combination thereof.

In one aspect, the engagement head 109 can include a sensor configured to detect a force applied to a tubular 308. In particular instances, the engagement head 109 can be configured to have selectable force or pressure settings, wherein the engagement head 109 can have different pressure states based upon at least one characteristic of a tubular 308. For example, the engagement head 109 can be configured to adapt a force applied to a tubular based on the size of the tubular. In one embodiment, the sensor 305 of the engagement head 109 can detect a diameter of the tubular to be engaged with the engagement head 109 and select a force to be applied to the tubular 308 based upon the detected diameter of the tubular 308. In certain other aspects, the sensor 305 may generate a signal representative of the detected diameter of the tubular 308 that can be sent to an operator of the tubular lift system. The operator can then select a force to be applied by the engagement head 109 to the tubular 308 based upon the detected diameter of the tubular 308.

In accordance with one aspect, the engagement head 109 can be configured to adapt to tubulars of different diameters, and more particularly, may have a jaw configured to grasp tubulars of different diameters. For example, in one embodiment, the engagement head 109 can include a sensor 305 that is configured to detect a size, and more particularly, detect an external diameter of a tubular 308. Based upon the size of the tubular 308, the engagement head 109 can be configured to adapt to the size of the tubular. For example, in one embodiment, the size of the opening 316 defined between the first portion 301 and the second portion 302 can change in dimension in response to a detected size of the tubular 308.

In accordance with another embodiment, the engagement head 109 can include a sensor, such as the sensor 305, which can be configured to detect a location of the tubular 308 relative to at least one surface of the engagement head 109. For example, the engagement head 109 can detect a location of a tubular 308 relative to at least one surface, such as a surface of the first portion 301 of the engagement head 109.

It will be appreciated that reference herein to a sensor 305 is non-limiting. For example, a suitable sensor may be placed on any portion of the engagement head assembly 311 or with any component of the engagement head assembly 311 to facilitate detection of any one of the location tubular 308, size of a tubular 308, force applied to a tubular, and relative position of one of the components of the engagement head assembly 311 relative to another component of the tubular lift system 130. For example, in one instance, the engagement head assembly 311 can include at least one sensor configured to detect a position of the engagement head 109 relative to a position on the engagement head tower 304. In another embodiment, the engagement head assembly 311 may include at least one sensor configured to detect at least one of a rotational position of the engagement head 109, a vertical position of the engagement head 109, a horizontal position of the engagement head 109, a position of a tubular with respect to the engagement head 109, an angular variation of the tubular relative to a predetermined vertical axis, and any other combination thereof.

Figure 3C:
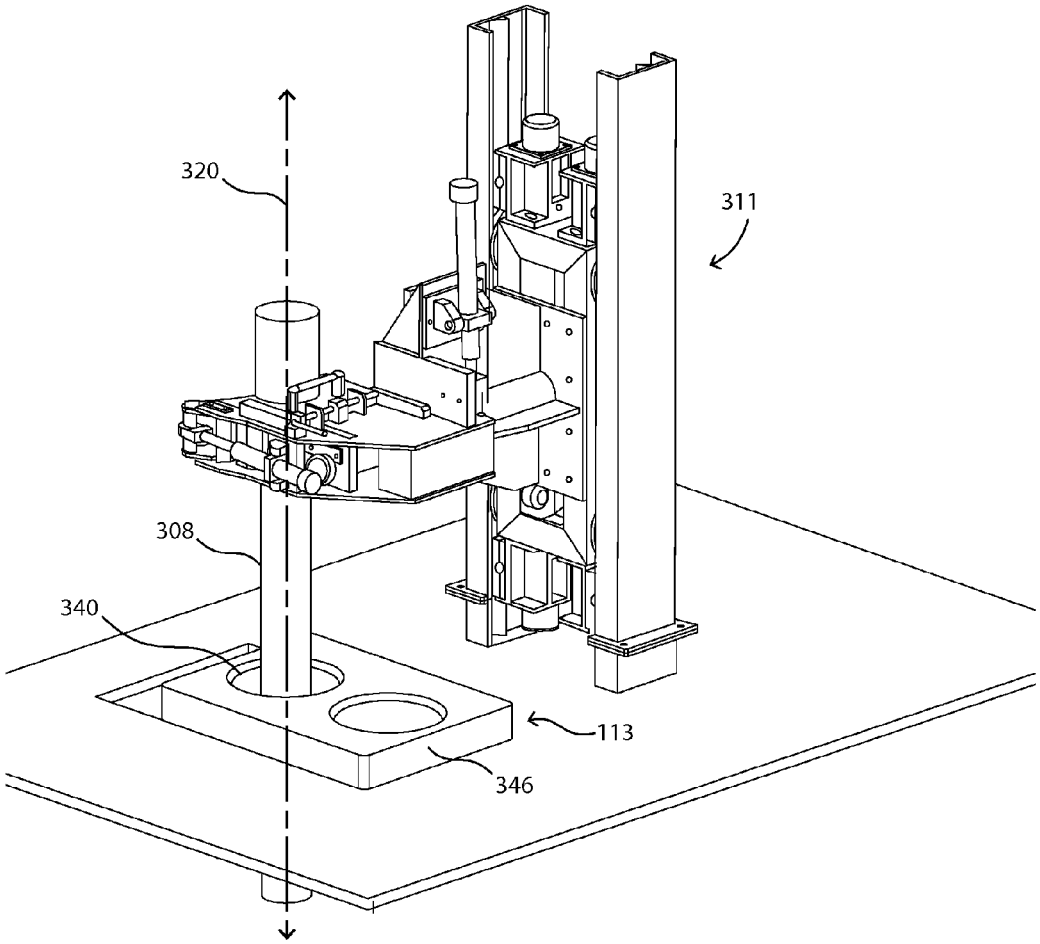

FIG. 3C includes a perspective view illustration of an engagement head assembly and a mousehole assembly in accordance with an embodiment. As illustrated, the tubular 308 has changed position from a substantially horizontal position, as illustrated in FIG. 3A, to a substantially vertical position, as illustrated in FIG. 3C. Furthermore, the tubular 308 has been translated along a predetermined vertical axis and positioned within a mousehole assembly 113. In accordance with an embodiment, the engagement head 109 can be configured to translate vertically in a vertical direction 396 along the engagement head tower 304 and translate the tubular 308 in a vertical position along the predetermined vertical axis. Notably, one particular aspect of the present tubular lift system is the ability to maintain a stabilized state of the tubular, such that the tubular has a very low angular variation with respect to a predetermined axis. The stabilized state may be achieved when the tubular 308 is initially secured in the substantially vertical position, and further while translating the tubular 308 along the predetermined vertical axis to deliver the tubular to the mousehole assembly 113.

Figure 8:
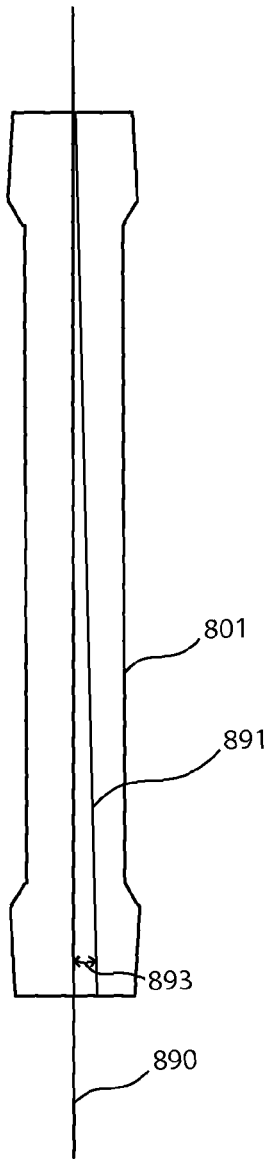
FIG. 8 includes an illustration of a tubular in a stabilized state and a controlled angular variation in accordance with an embodiment.

According to one embodiment, the tubular 308 can be configured to be translated along the predetermined vertical axis in a stabilized state having an angular variation of not greater than about 5 degrees. Suitable angular variation can facilitate efficient operations, and particularly, efficient stand-building operations. The angular variation of the tubular can be measured as an angle between the predetermined vertical axis and a longitudinal axis of the tubular 308. FIG. 8 includes an illustration of a tubular and the angular variation. As illustrated, the tubular 801 can have a longitudinal axis 891 corresponding and parallel to a direction of the length of the tubular 801. The tubular can be oriented with respect to a predetermined vertical axis 890, and notably, an angle 893 can define an angle between the predetermined vertical axis 890 and the longitudinal axis 891 of the tubular 801. As noted herein, in a stabilized state, the angular variation of the tubular 801 can be particularly low, such as not greater than about 4.4 degrees, such as not greater than about 4 degrees, not greater than about 3.5 degrees, not greater than about 3 degrees, not greater than about 2.8 degrees, not greater that about 2.6 degrees, not greater than about 2.4 degrees, not greater than about 2.2 degrees, or even not greater than about 2 degrees.

In accordance with an embodiment, other elements may engage the tubular and assist with the change in position from the substantially horizontal position to the substantially vertical position. For example, the tubular lift system 130 can include a stabilizer 111, which is generally illustrated in FIG. 1A, FIG. 1B, FIGS. 6A-6F, FIG. 7A, and FIG. 7B and described in more detail herein. Notably, the stabilizer 111 can be configured to engage a distal end region 262 of a tubular and reduce uncontrolled motion (e.g., swinging motion) of the distal end region 262 of the tubular during a change of position of the tubular from a substantially horizontal position to the substantially vertical position. Aspects of the stabilizer 111 are described in more detail herein.

The tubular lift system 130 can further include one or more alignment elements. During movement of the tubular 308 from a substantially horizontal position to a substantially vertical position the tubular 308 may be engaged by at least one alignment element. FIGS. 6G-6I include schematic views of a portion of a tubular lift system including alignment elements, and aspects of the alignment elements are described in more detail herein.

As further illustrated in FIG. 3A, the system for manipulating tubulars can include a mousehole assembly 113. FIGS. 3A-3F provide further illustrations the mousehole assembly and operation of the mousehole assembly in accordance with an embodiment. The mousehole assembly 113 can include a first mousehole 340, a second mousehole 341 spaced apart from the first mousehole 340, and a cavity 345 contained with the drill floor 103. The mousehole assembly 113 can further include a first opening 343 defined by the first mousehole 340 and configured to accept a tubular 308 therein. As further illustrated, the mousehole assembly 113 can include a second opening 344 associated with the second mousehole 341 and configured to accept a different tubular therein. In accordance with an embodiment, the first mousehole 340 can define a first central axis 320 extending in the vertical direction 396 and through a centerpoint of the first opening 343 of the first mousehole 340. Furthermore, the second mousehole 341 can define a second central axis 330 extending in the vertical direction 396 and through a centerpoint of the second opening 344 of the second mousehole 341. In accordance with one aspect, the mousehole assembly 113 can be configured to selectively move and align the first central axis 320 or second central axis 330 with a predetermined vertical axis to facilitate efficient loading of the tubulars within the mousehole assembly 113.

As illustrated in FIG. 3A, the mousehole assembly 113 can include a cavity 345 and a mousehole structure 346. The mousehole structure 346 can contain the first mousehole 340 and second mousehole 341. As will be appreciated, the cavity 345 within the drill floor 103 may facilitate movement of the mousehole structure 346 relative to a position on the drill floor 103. In particular instances, the mousehole structure 346 can be configured to move within the cavity 345 to facilitate alignment of the first central axis 320 of the first mousehole 340 or the second central axis 330 of the second mousehole 341 with a predetermined vertical axis. In at least one embodiment, the utilization of a mousehole structure 346 can facilitate movement of the first mousehole 341 and second mousehole 341 simultaneously with respect to each other. However, it will be appreciated that other designs may be employed, wherein the first mousehole 341 may be moved independently of the second mousehole 341, including for example utilization of at least two different mousehole structures associated with two distinct mouseholes within a cavity.

The mousehole assembly 113, and more particularly, the mousehole structure 346, can be configured to translate for a particular distance within the cavity 345. As illustrated, the cavity 345 can have a length designated CL. In certain instances, the mousehole structure can be configured to be translated within the cavity for a distance of at least about 0.1(CL). In other embodiments, the mousehole structure 346 can be configured to move at least about 0.2(CL), at least about 0.3(CL), at least about 0.4(CL), or even at least about 0.5(CL). Still, in one non-limiting embodiment, the mousehole structure may be configured to move not greater than about 0.8(CL), such as not greater than about 0.7(CL), or even not greater than about 0.6(CL). In one particular instance, the distance between the first central axis 320 of the first mousehole 340 and the second central axis 330 of the second mousehole 341 can be the same as the distance the mousehole structure 346 is translated within the cavity 345.

Figure 3D:
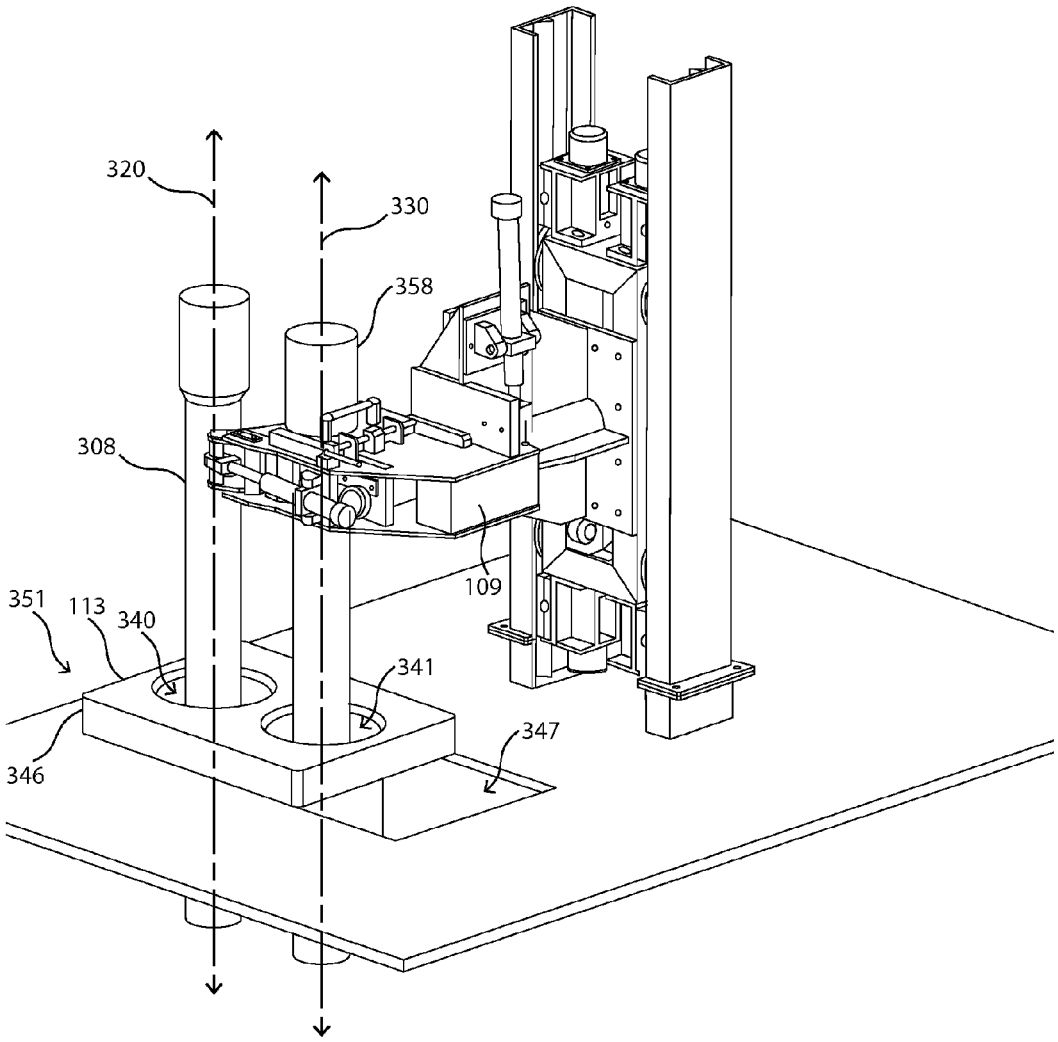

In accordance with an embodiment, the mousehole assembly 113 can include at least one actuator configured to move at least a portion of the mousehole assembly relative to the drill floor 103. The actuator can include at least one drive device as described in embodiments herein, such as a motor, a hydraulic device, a pneumatic device, a stepper motor, a servo motor, DC motor, AC motor, and a combination thereof. As noted herein, it will be appreciated that reference to moving at least a portion of the mousehole assembly 113 can include independently moving any one of the components of the mousehole assembly 113, including for example, but not limited to, the first mousehole 340, the second mousehole 341, and the mousehole structure 346. In the design of the mousehole assembly 113 illustrated in FIGS. 3A-3F, it will be appreciated that the at least one actuator can be configured to translate the mousehole structure 346 from a first position 348 as illustrated in FIG. 3A to a second position 351, as illustrated in FIG. 3D. The manner in which the first and second mouseholes 340 and 341 are moved with respect to each other is not limited by the illustrated embodiments herein.

As noted herein, the mousehole assembly 113 can be configured to move relative to a surface in the work zone 131. In particular, the mousehole assembly 113 may be configured to move relative to the drill floor 103, and more particularly, may change position relative to one or more components (e.g., the engagement arm 109) of the tubular lift system 130. It will be appreciated that reference herein to movement of at least a portion of the mousehole assembly 113 can include movement in any of the directions noted herein, including a lateral direction 398, a horizontal direction 397, and a vertical direction 396. For example, in one particular embodiment the relative movement of the mousehole assembly 113 to a surface of the drill floor 103 can include rotation, translation, and a combination thereof. While the embodiments herein generally show translation of the mousehole assembly 113 in a horizontal direction 397, it will be appreciated that other designs may be utilized that allow for distinct movement of a mousehole assembly in other directions.

As noted herein, the mousehole assembly 113 can be disposed within the work zone 131. More particularly, the mousehole assembly 113 can be space away from an operator zone 132. Accordingly, the mousehole assembly 113 may be configured to be operated by an operator contained within the operator zone 132 and spaced away from the work zone 131. In certain instances, the mousehole assembly 113 may be controlled from the operator zone 132 via an input module. Suitable input modules can include those noted herein, including but not limited to, a device such as a control column, a joystick, an analog device, a digital device, a potentiometer, a variable resistor, a gyroscope, and a combination thereof. In one particular embodiment, the mousehole assembly 113 may be an automated system, such that the controlled movement or controlled sequence of operations of the mousehole assembly 113 can be controlled by actuation of a single switch.

In particular embodiments, the cavity 345 may be configured to have a cover 347. The cover 347 may underlie the drill floor 103. In other embodiments, the cover 347 may overlie the drill floor 103. Furthermore, the cover 347 may be movable relative to the mousehole structure 346, thus limiting any openings below the drill floor 103 and limiting potential hazards within the work zone 131. In at least one embodiment, the cover 347 can be configured to move between a first position and a second position. For example, the cover 347 can be configured to be movable between a first position and a second position relative to the first position and second position of the mousehole structure 346.

As noted in FIG. 3A, the mousehole assembly 113 can be provided in a first position 348, wherein the first central axis 320 of the first mousehole 340 can be aligned with a predetermined vertical axis. In particular, in the first position 348 the first central axis 320 of the first mousehole 340 defines the predetermined vertical axis, such that the first central axis 320 and the predetermined vertical axis are the same. Moreover, in the first position 348 of the mousehole structure 346, the second central axis 330 can be displaced a distance away from the first central axis 320, and thus, displaced a distance from the predetermined vertical axis in the horizontal direction 397.

Referring now to FIG. 3D, the mousehole assembly 113 is illustrated as changed in position from the first position 348, as illustrated in FIG. 3A, to a second position 351, as illustrated in FIG. 3D. Moreover, as will be appreciated, in changing the position of the mousehole structure 346, the position of the cavity 347 may change. Notably, in the second position 351, the cavity 347 can be disposed on the opposite side of the mousehole structure 346 as compared to the position of the cavity 347 relative to the mousehole structure 346 in the first position 348. Furthermore, in the second position 351, the second central axis 330 of the second mousehole 341 can be aligned with the predetermined vertical axis to facilitate delivery of a second tubular 358 to the second mousehole 341. More particularly, in the second position 351, the second central axis 330 can define the predetermined vertical axis. In particular, at the second position 351, the first central axis 320 of the first mousehole 340 can be displaced a distance from the second central axis 330 of the second mousehole 341 and from the predetermined vertical axis defined by the second central axis 330 of the second mousehole 341.

In accordance with an embodiment, the first mousehole 341 can define a first opening 343 having a first diameter. Moreover, the second mousehole 341 can define a second opening 344 having a second diameter. In accordance with an embodiment, the first diameter of the first opening 343 and the second diameter of the second opening 344 can be substantially similar. More particularly, the size of the openings 343 and 344 can be essentially the same.

The mousehole assembly 113 may be equipped with one or more sensors or transducers to facilitate detection of certain characteristics of the process and adaptation of the mousehole assembly 113 for particular conditions. For example, in one embodiment the mousehole assembly 113 can include at least one sensor such that it is configured to adapt to tubulars of different sizes, and more particularly, tubulars of different diameters. In one embodiment, the first mousehole 340 can have at least one mechanical device facilitating a change in the diameter of the first opening 343 to facilitate reception of tubulars of different diameters. For example, in one embodiment the first mousehole 340 can have a first opening position configured to receive a first tubular of a first diameter and a second opening position configured to accept a second tubular having a second diameter different than the first diameter.

It will be appreciated that the second mousehole 341 can utilize the same features noted above for the first mousehole 340. In one aspect, the second mousehole 341 may include a sensor configured to detect a tubular to be disposed therein, and more particularly, configured to adapt to tubulars of different sizes. In certain instances, the second mousehole 341 may be adaptable, such that is has a first opening position configured for a first tubular having a first diameter, and a second opening position configured to receive a second tubular having a second diameter different than the first diameter. As such, the second mousehole 341 may be capable of changing the size of the second opening 344 to facilitate receiving of tubulars of different diameters.

In one embodiment, the mousehole assembly 113 can include a sensor that can be configured to detect an alignment between a predetermined vertical axis and the first central axis 320 of the first mousehole 340 or between the predetermined vertical axis and the second central axis 330 of the second mousehole 341. It will be appreciated that such a sensor can be placed on any of the components of the mousehole assembly 113, including for example, inside the first mousehole 340 or inside the second mousehole 341. In certain instances, the mousehole assembly 113 can include a sensor that is configured to detect an alignment between the predetermined vertical axis and the first central axis 320 or the second central axis 330, and further configured to change a position of the first mousehole 340 or the second mousehole 341 based on a signal including alignment data. For example, the sensor may detect a misalignment between the first central axis 320 and the predetermined vertical axis and send a signal to facilitate adjustment of the position of one or more of the components of the mousehole assembly 113 (e.g. the mousehole structure 348) to achieve suitable alignment between the first central axis 320 and the predetermined vertical axis or the second central axis 330 and the predetermined vertical axis.

Referring now to FIG. 3A-3F the process of manipulating tubulars and utilizing the mousehole assembly 113 will be described. At a first time, the first mousehole 340 can be at a first position 348, as provided in FIG. 3A, and at a second time different than the first time the first mousehole 340 can be at a second position 351 different than the first position 348, as shown in FIG. 3D. Likewise the same displacement of the first mousehole 340 at different times can apply for the second mousehole 341. Accordingly, at a first time the first mousehole 340 can have a first central axis 320 aligned with a predetermined vertical axis associated with a longitudinal axis of a first tubular 308 in a substantially vertical position. At the second time, referring to FIG. 3D the first mousehole 340 can be displaced a distance from the predetermined vertical axis and the second mousehole 341 can have a second central axis 330 aligned with a predetermined vertical axis associated with a longitudinal axis of the second tubular 358 and configured to receive the second tubular 358 within the second mousehole 341.

As illustrated, at a first time illustrated in FIG. 3A a first tubular 308 can be in a substantially horizontal position and in an initial position to be engaged by the engagement head 109. Furthermore, the mousehole assembly 113 can be in a first position 348 having a first central axis 320 of the first mousehole 340 aligned with a predetermined vertical axis and in a position to receive the first tubular 308.

At a second time as illustrated in FIG. 3B, the first tubular 308 can be manipulated by the engagement head 109 and lifted along the engagement head axis 310. Simultaneously while lifting the first tubular 308 along the engagement head axis 310, the engagement head can be rotating in the direction 316 to facilitate a change in the position of the first tubular 308 from a substantially horizontal position toward a substantially vertical position. As further illustrated in FIG. 3C after changing the position of the tubular 308 to a substantially vertical position, the engagement head 109 can move vertically downward and the first tubular 308, which is aligned with a predetermined vertical axis that corresponds to a first central axis 320 of the first mousehole 340, can be delivered in a stabilized state to the first mousehole 340.

FIG. 3D includes a perspective view illustration of a mousehole assembly and engagement head assembly in accordance with an embodiment. As illustrated in FIG. 3D, after securing the first tubular 308 within the first mousehole 340, a second tubular 358 can be taken from a substantially horizontal position and manipulated into a substantially vertical position such that the second tubular 358 has the longitudinal axis aligned with a predetermined vertical axis. Notably, the mousehole structure 346 has changed to the second position 351. In the second position 351, the second central axis 330 of the second mousehole 341 is aligned with and defines the predetermined vertical axis. Accordingly, as illustrated, the second tubular 358 can be delivered in a stabilized state to the second mousehole 341.

Figure 3E:
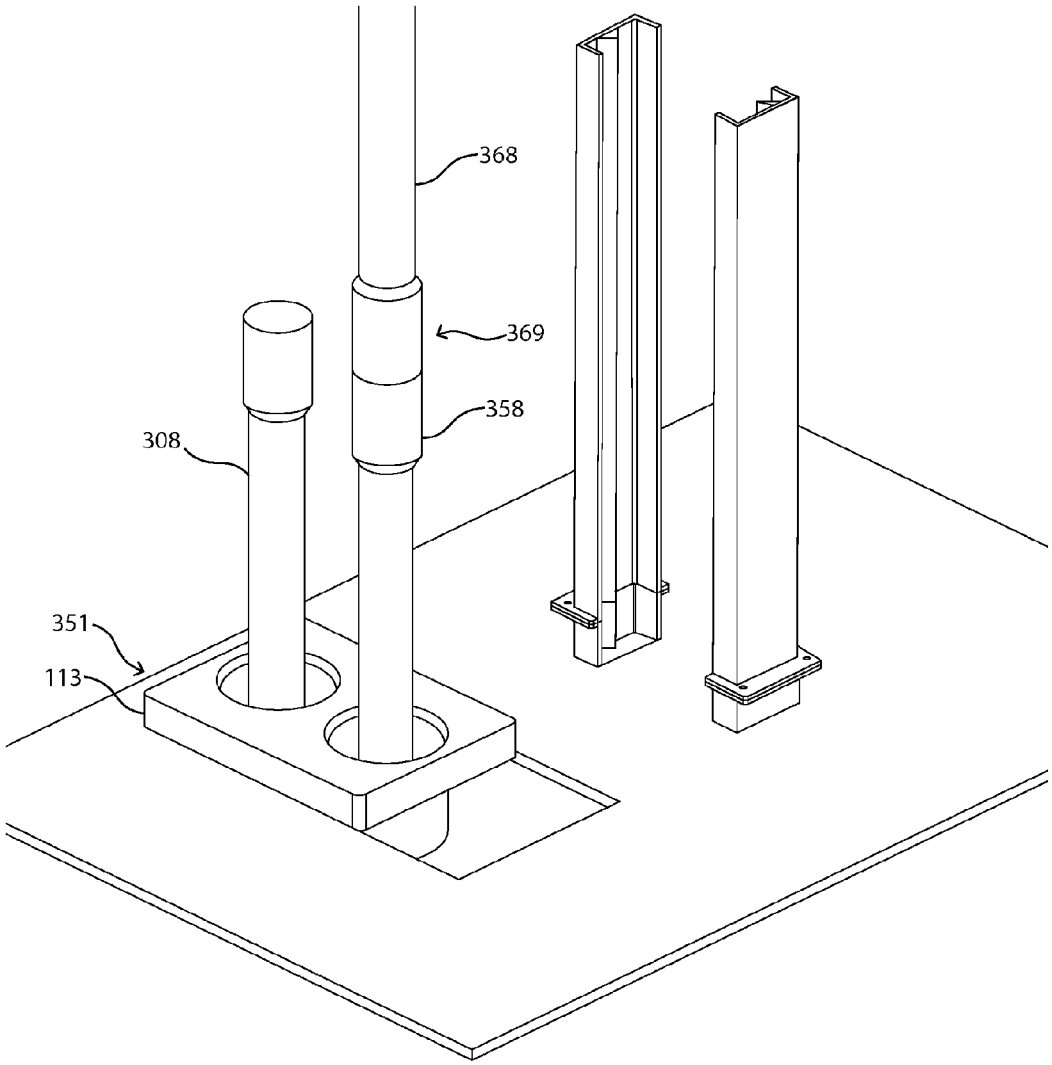

FIG. 3E includes an illustration of a third tubular 368 being joined with the second tubular 358. It will be appreciated that the third tubular 368 can be manipulated in the same manner as the second tubular 358. Joining of the third tubular 368 and second tubular 358 may be facilitated by the use of an iron roughneck 112. Notably, as illustrated in FIG. 3E, the joining of the second tubular 358 and third tubular 368 can be facilitated by utilization of the mousehole assembly 113 in the second position 351. It will further be appreciated that the joining of the second tubular 358 with the third tubular 368 can form a double 369.

Figure 3F:
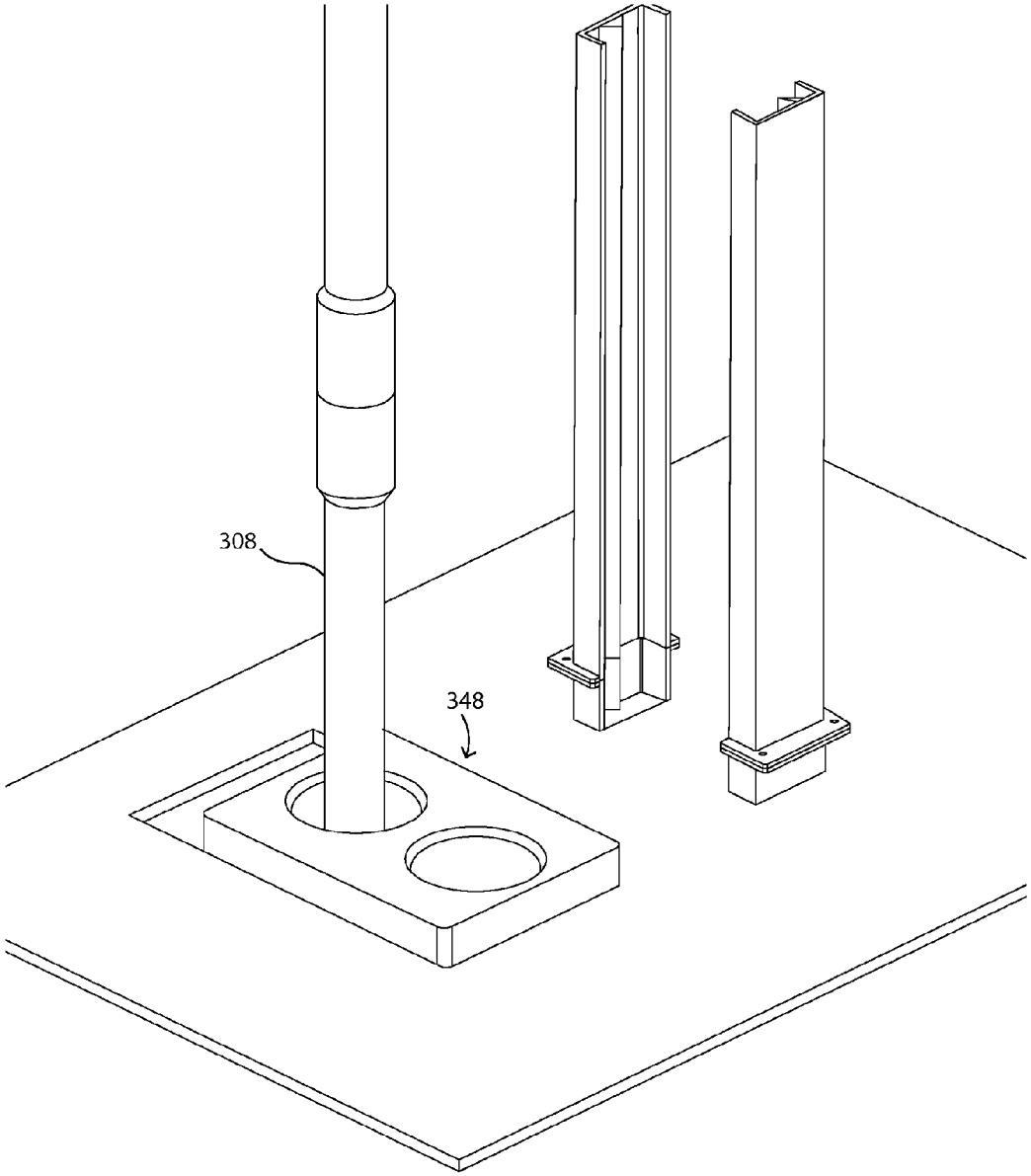
Figure 4:
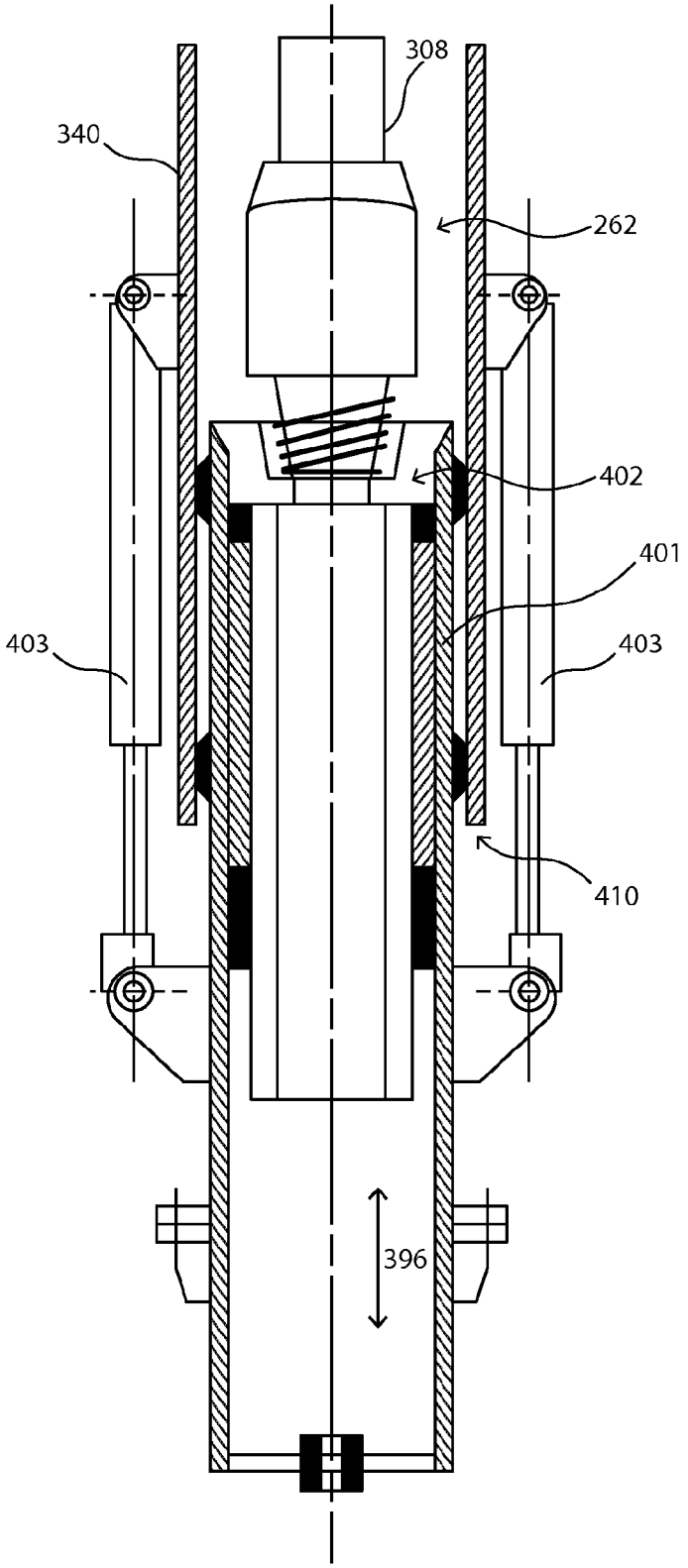
FIG. 4 includes a cross-sectional view illustration of a portion of a mousehole assembly in accordance with an embodiment.

As further illustrated in FIG. 3F, the double 369 may be removed from the second mousehole 341 and the mousehole structure 346 can be shifted to the first position 348. As such, the central axis 330 of the first mousehole 340 and the longitudinal axis of the first tubular 308 can be aligned with the longitudinal axis of the double 369 to facilitated joining of the double 369 with the first tubular 308 and the formation of a stand. Joining of the double 369 and the first tubular 308 may be facilitated by the use of an iron roughneck 112.

GRIPHEAD

The following is reference to a griphead, which is a tool that can be used in the tubular lift system 130 to facilitate further manipulation of one or more tubulars (e.g., a stand). Distinct from other tools described herein, the griphead may be utilized in a racking procedure wherein a string of tubulars may be placed on the rack 115 and made ready for use at the well center 188. Referring briefly to FIG. 1, a griphead 114 is generally shown as a device suitable for grasping and manipulating tubulars or strings of tubulars and moving the tubulars from the stand-building area, to a rack 115, and further to the well center 188 to be used in the active drilling operation.

Figure 5A:
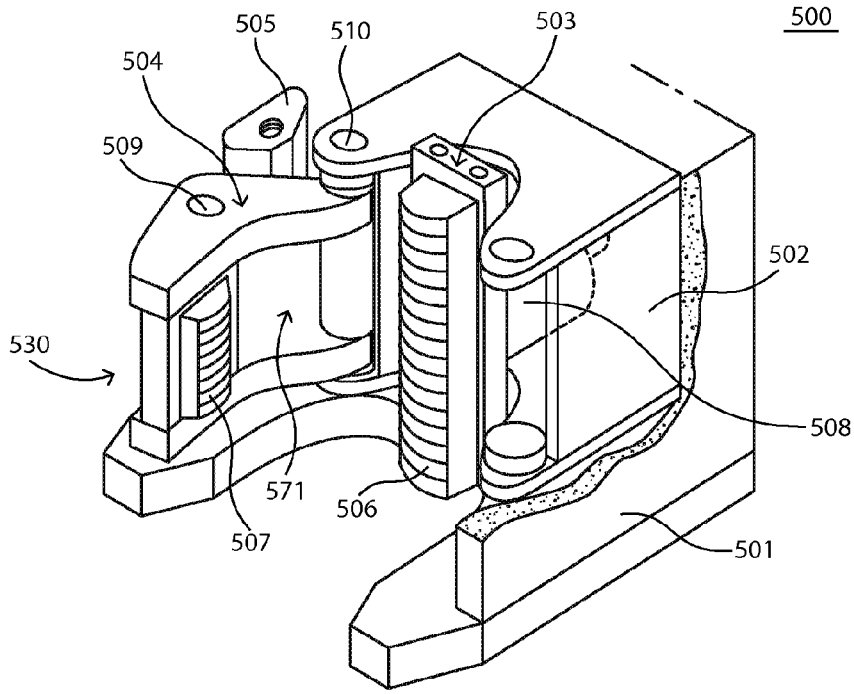
FIG. 5A includes a perspective view illustration of a grip head in accordance with an embodiment.
Figure 5B:
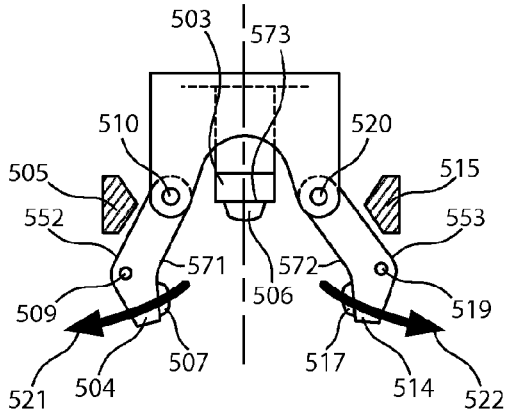
FIG. 5B includes a top view illustration of a portion of a grip head in an open position in accordance with an embodiment.
Figure 5C:
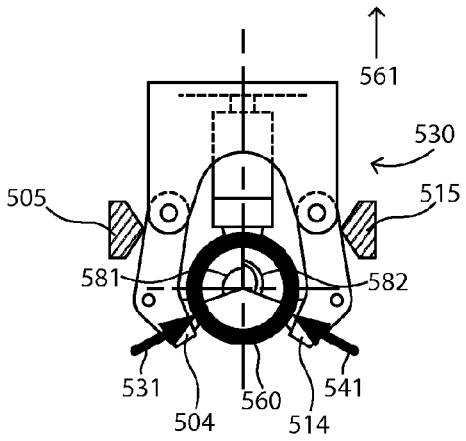
FIG. 5C includes a top view illustration of grip head engaging a tubular in accordance with an embodiment.

FIGS. 5A, 5B, and 5C provide illustrations of a griphead in accordance with an embodiment. In particular FIG. 5A includes a perspective view illustration of a griphead in accordance with an embodiment. FIG. 5B includes a top view of a griphead in accordance with an embodiment. FIG. 5C includes a top view illustration of a griphead in accordance with an embodiment.

The griphead 500 can include a housing 501 and a jaw assembly 530 contained within the housing 501. The jaw assembly 530 can include an actuator box 502 contained within the housing 501. Furthermore, the jaw assembly 530 can include a first arm 504 configured to be actuated between an open position and a closed position by controlling a relative position of the first arm 504 with respect to a first bumper 505.

As further illustrated, the first arm 504 can be coupled to the actuator box 502 via a fastener 510. Notably, in one embodiment, the first arm 504 can be coupled to the actuator box 502 at the fastener 510 and configured to rotate around a portion of the actuator box 502 in direction 521 or 531 at the fastener 510. Likewise, the second arm 514 can be coupled to the actuator box 502 at a fastener 520. More particularly, the second arm 514 can be coupled to the actuator box 502 and configured to rotate around a position of the actuator box 502 in direction 522 or 541 at the fastener 520. The fastener 510 can be configured to allow rotational motion of the first arm 504 relative to the housing 501. The fastener 520 can be configured to allow rotational motion of the second arm 514 relative to the housing 501. The fasteners 510 and 520 can include components such as a hinge, a pin, and the like.

As noted herein the jaw assembly 530 can include a first arm 504, wherein in the open position, the first arm 504 can be spaced away from the first bumper 505 and in a closed position the first arm 504 can be configured to be engaged with (i.e., abutting) the first bumper 505. In certain instances, the engagement of the first arm 504 with the first bumper 505 can facilitate movement of the first arm 504 in direction 531 and a change of position of the first arm 504 from an open position, as provided in FIG. 5B, to a closed position, as illustrated in FIG. 5C. Movement of the first arm 504 from an open position to a closed position can facilitate grasping of a tubular 550 within the jaw assembly 530.

The grip head 500 can include a first bumper 505 which can be affixed to the housing 501. As such, the first bumper 505 may be a stationary article securely fixed in place on the housing 501 such that relative motion of the first arm 504 to the bumper 505 is caused by the motion of the first arm 504 towards the stationary first bumper 505. Still in an alternative embodiment, the first bumper 505 may be configured to be moved between a first position and second position. Notably, the first position of the first bumper 505 can correspond to an open position of the first arm 504 and a second position of the first bumper 505 can correspond to a closed position of the first arm 504.

The first arm 504 may include a first pin 509 extending from an upper surface of the first arm and configured to be engaged in a first slot within the housing 502. In accordance with an embodiment, the first pin 509 can extend from an upper surface of the first arm 504 and engaged with a first slot in the housing 501. The first pin 509 can be configured to translate between a first position and a second position within the first slot in the housing 501. In accordance with an embodiment, the first position of the first pin 509 can correspond to an open position of the first arm 504 (see FIG. 5B) and a second position of the first pin 509 within the first slot of the housing 501 can correspond to a closed position of the first arm 504 (FIG. 5C).

The griphead 500 can further include a jaw assembly 530 including a second arm 514 configured to be moveable between an open position and a closed position by controlling a position of the second arm 514 relative to a second bumper 515. The second arm 514 that can be configured to be moved between an open position, as generally illustrated in FIG. 5B, to a closed position, as generally illustrated in FIG. 5C. In particular, in an open position the second arm 514 can be spaced away from the second bumper 515, while in a closed position the second arm 514 can be engaged with and abutting the second bumper 515. In particular instances, engagement of the second arm 514 with the second bumper 515 can facilitate rotational motion of the second arm 514 from the open position to the closed position. The second bumper 515 may be attached to the housing 501, and more particularly, may be fixably attached to the housing 501. Movement of the second arm 514 from an open position to a closed position can facilitate grasping of a tubular 550 within the jaw assembly 530.

The second bumper 515 can be affixed to the housing 501, and more particularly, may be a stationary article securely fixed in place on the housing 501 such that relative motion of the second arm 514 relative to the first bumper 515 is caused by the motion of the second arm 514 towards the stationary second bumper 515. Still in an alternative embodiment, the second bumper 515 may be configured to be moved between a first position and second position. Notably, the first position of the second bumper 515 can correspond to an open position of the second arm 514 and a second position of the second bumper 515 can correspond to a closed position of the second arm 514.

Moreover, the second arm 514 may include a second pin 519 configured to be engaged within a second slot within the housing 501. In particular, the second arm 514 can include an upper surface and a second pin 519 extending from the upper surface and configured to engage a second slot in the housing 501. Notably, the second pin may be configured to translate between a first position and second position within the second slot of the housing 501. The first position of the second pin 519 can correspond to an open position of the second arm 514, while the second position of the second pin 519 within the second slot can correspond to a closed position of the second arm 514, such as shown in FIG. 5C. It will be appreciated that changing of the second arm 514 from an open position, such as shown in FIG. 5B, to a closed position, such as shown in FIG. 5C can facilitate grasping of a tubular 550 within the jaw assembly 530.

Movement of the jaw assembly 530 from an open position, such as shown in FIG. 5B, to a closed position, such as shown in FIG. 5C, can be facilitated by translation of one of more components of the griphead 500. In particular instances, the jaw assembly 530 can be configured to be translated in a linear direction relative to the housing 501. Moreover, translation in a linear direction of the jaw assembly 530 relative to the housing 501 can facilitate rotational movement of the first arm 504 and second arm 514. In accordance with one particular embodiment, the first arm 504 can be moved from an open position such as shown in FIG. 5B to a closed position such as shown in FIG. 5C by movement of the jaw assembly 530 in a linear direction 561 relative to the housing 501. In one aspect, the linear motion of the jaw assembly 530 can cause an outer surface 552 of the first arm 504 to abut the first bumper 505 and urge rotational movement of the first arm 504 in the direction 531 around the fastener 510. Moreover, the linear motion of the jaw assembly 530 in the direction 561 can cause an outer surface 753 of the second arm 514 to abut the second bumper 515, urging rotational movement of the second arm 514 in the direction 541 about the fastener 520 and movement of the second arm 514 from an open position as shown in FIG. 5B to a closed position as shown in FIG. 5C.

As further illustrated, the jaw assembly 530 can include an actuator box 502 that can be configured to be translated in the linear direction 561. In accordance with an embodiment, the actuator box 502 can be configured to move between a first position and a second position relative to the housing 501. Moreover, the actuator box 502 can be configured to move between a first position corresponding to an open position of the first arm 504 and second arm 514 to a second position corresponding to a closed position of the first arm 504 and second arm 514. Referring more particularly to FIGS. 5B and 5C, movement of the actuator box 502 from a first position to a second position in the direction 561 facilitates engagement of the first arm 504 with the first bumper 505 and the second arm 514 with the second bumper 515 and rotational motion of the first arm 504 and second arm 514 from an open position to a closed position. Furthermore, it will be appreciated that the linear movement of the actuator box 502 in the direction 561 may also result in some linear movement of the first arm 504 and second arm 514 in generally the same direction 561, until the first arm 504 and second arm 514 engage and abut the first bumper 505 and second bumper 515, respectively.

Upon abutting the first bumper 505 with the first arm 504 the linear movement of the first arm 504 in the direction 561 may be translated to additional rotational motion in direction 531. Likewise, for the second arm 514 some linear translation of the second arm 514 may occur until the outer surface 753 of the second arm 514 abuts the second bumper 515

Movement of the jaw assembly 530, and more particularly, the actuator box 502 may be facilitated by a drive device. One suitable drive device can include a piston 508. The piston 508 can be coupled to a central arm 503 disposed between the first arm 504 and second arm 514. In one embodiment, the piston 508 can be fixably attached to the housing 501 and intended to be held stationary with respect to the housing 501. According to another embodiment, the central arm 503 can be configured to engage a tubular 550 and the gripping force on the tubular 550 may be controlled by a position of the central arm 503 relative to the jaw assembly 530. The piston 508 can be configured to move between a first position and a second position, which can be configured to facilitate motion of the first arm 504 between the open position and closed position corresponding to the first position and second position of the piston 508. Moreover, movement of the piston 508 between the first position and second position can be configured to facilitate motion of the second arm 514 between the open position and closed position corresponding to the first position and second position of the piston 508.

In at least one embodiment, the piston 508 can be coupled to a sensor configured to measure a force (or pressure) applied by the piston to the actuator box 502. In certain instances, the sensor can include a transducer that is configured to measure a pressure applied by the piston 508 on the actuator box 502 and generate a signal based on the pressure. The signal may be used to modify or adjust the pressure applied by the piston 508 on the actuator box 502. It will be appreciated that the measurement and adjustment of pressure by the piston 508 and the sensor on the actuator box 502 can facilitate adjustment of pressure applied by the jaw assembly 503 on a tubular 550. The adjustment of the pressure applied by the piston 508 can be facilitated by the use of a logic device. The logic device may be configured to adjust the pressure applied by the piston based on the signal generated from the transducer. Alternatively, a signal may be sent to an operator in operator zone 132 and the operator may select a suitable pressure to be applied by the piston 508 based upon the signal.

The griphead 500 may further include a sensor configured to measure at least one aspect of a tubular 550. For example, the griphead 500 can include a sensor configured to measure a diameter of a tubular 550. Measurement of an aspect of a tubular, including for example a diameter of a tubular, may facilitate selection and adjustment of a grip pressure applied by the jaw assembly 530 to the tubular 550. That is, the grip pressure of the jaw assembly 530 applied on a tubular 550 can be adjusted based on the diameter of the tubular 550.

In an alternative embodiment, a grip pressure applied by the jaw assembly 530 on a tubular can be adjusted based upon the pressure applied by the piston 508 to the actuator box 502 of the jaw assembly 530. Moreover, the grip pressure of the jaw assembly 530 may be adjusted based on the pressure applied by the piston 508 to the central arm 503 in contact with the tubular 550. For example, the greater the force applied by the piston 508, the further the movement of the actuator box 502 in the direction 561, and thus the greater the force applied on the first arm 504 and second arm 514 to urge rotation to a closed position, and the greater the force applied on the tubular 560.

The griphead 500 may be formed such that the jaw assembly 530 can be adapted to grasp tubular having various diameters. In particular, the jaw assembly 530 may configured to securely hold tubulars having a diameter of at least about 4 inches, such as at least about 4.5 inches, at least about 5 inches, or even at least about 6 inches. And still other embodiments, the jaw assembly 530 of the grip head 500 may be configured to securely grasp tubulars having a diameter of not greater than about 25 inches, such as not greater than about 20 inches, not greater than about 18 inches, not greater than about 16 inches, not greater than about 14 inches, or even not greater than about 12 inches.

As further illustrated, the first arm 504 can include a first contact pad 507 configured to engage a portion of a tubular 550 in the closed position. The first contact pad can be coupled to an interior surface 571 of the first arm 504. Furthermore, the second arm 514 can have a second contact pad 517 coupled to an interior 572 of the second arm 514. Moreover, the central arm 503 can include a central contact pad 506 coupled to an interior surface 573 of the central arm 503. In accordance with a particular embodiment, the first contact pad 507 can have a convex curvature such that the exterior surface of the first contact pad 507 can be bowed outward away from the interior surface 571 of the first arm 504. The curvature of the first contact pad 507 in an outward manner can facilitate engagement of the tubular 550 on the first contact pad 507 and limit corner or edge contacts with the tubular and stress risers.

The second contact pad 517 can have a similar curvature to the first contact pad 507. For example, the second contact pad 517 can have a convex curvature or an outer surface curving outwards away from the interior surface 572 of the second arm 514, which may limit point contacts between the second contact pad 517 and the tubular 550. Furthermore, the central contact pad 506 can have a similar shape with respect to the first contact pad 507 or the second contact pad 517, including for example a convex curvature to limit point contacts and stress risers when in contact with the tubular 550.

As illustrated in FIG. 5C the first contact pad 507, second contact pad 517, and central contact pad 506 can be configured to contact the tubular 550 at particular locations. In accordance with an embodiment, the contact points, wherein the contact pads 507, 517, and 506 are in contact with the tubular 550 are spaced apart from each other by a central angle. For example, the central angle 581 can define an angle between a contact point of the central contact pad 506 and first contact pad 507 with the tubular 550, based on a centerpoint of the tubular as viewed in cross-section. Furthermore, the central angle 582 defines an angle between a contact point of the central contact pad 506 with the tubular 550 and a contact point of the second contact pad 517 with the tubular 550. In accordance with embodiment, the contact points can be spaced apart from each other by an angle having a value of at least about 90 degrees relative to the center of the tubular 550. In other embodiments, the central angle 581 or 582 can be greater, such as at least about 95 degrees, at least about 98 degrees, at least about 100 degrees, at least about 105 degrees, and the like. In other non-limiting embodiments, the central angle 581 or 582 can be not greater than about 170 degrees, or even not greater than about 160 degrees. Control of the central angle and location of contact points can facilitate suitable grip pressure to securely hold tubulars 550 having a variety of diameters within the jaw assembly 530.

In accordance with another aspect, the grip head 500 may utilize a maintenance kit for maintenance and replacement of certain portions of the griphead 500. In particular, a kit for maintenance can include replacement contact pads for any of the contact pads of the griphead 500. For example the maintenance kit may include at least one of a first contact pad 507 for a first arm 504, a second contact pad 517 for a second arm 514, and a central contact pad 704 for a central arm 503. It will be appreciated that the maintenance kit may sell each of the contact pads individually or together.

SYSTEM AND METHOD FOR MANIPULATING TUBULARS OF THE SUBTERRANEAN OPERATION

Figure 6A:
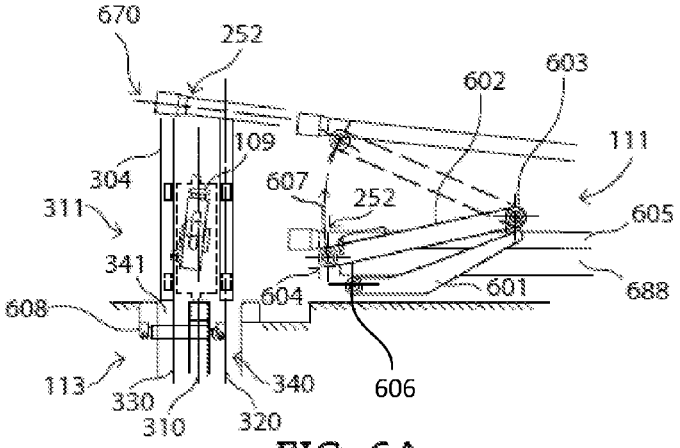
FIGS. 6A-6K include schematic illustrations of a system for manipulating tubulars for a subterranean operation in accordance with an embodiment.
Figure 6B:
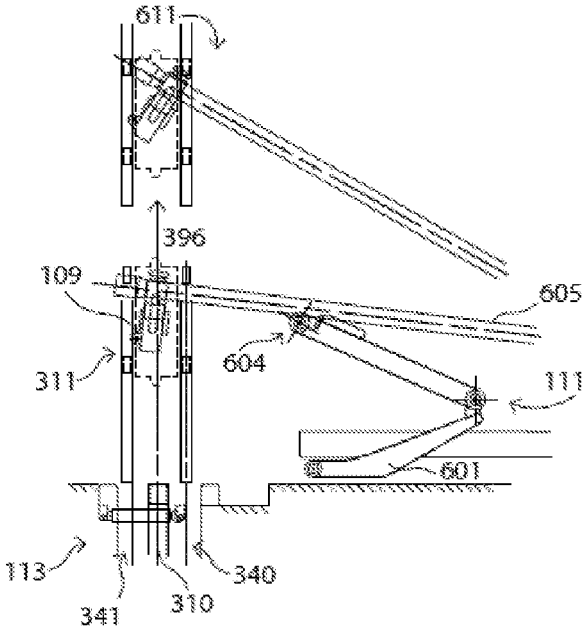
Figure 6C:
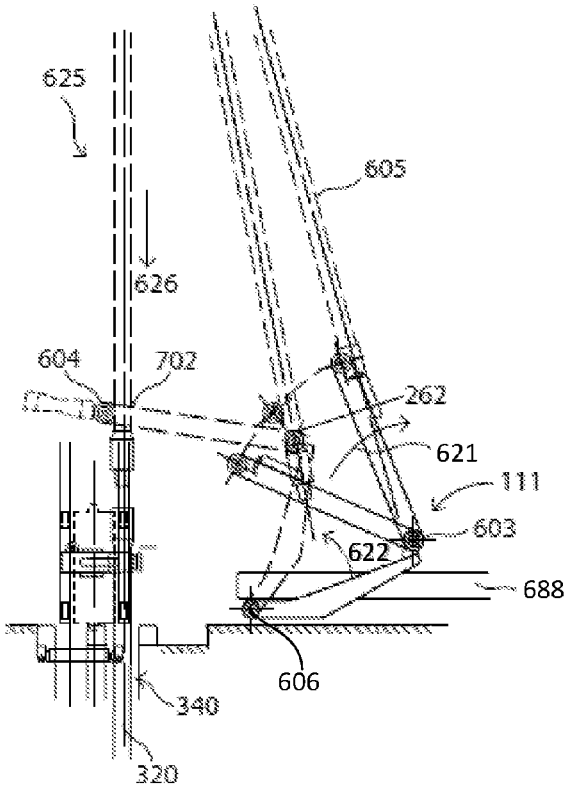
Figure 6D:
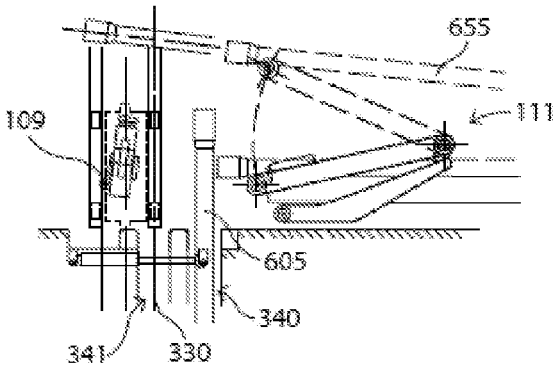
Figure 6E:
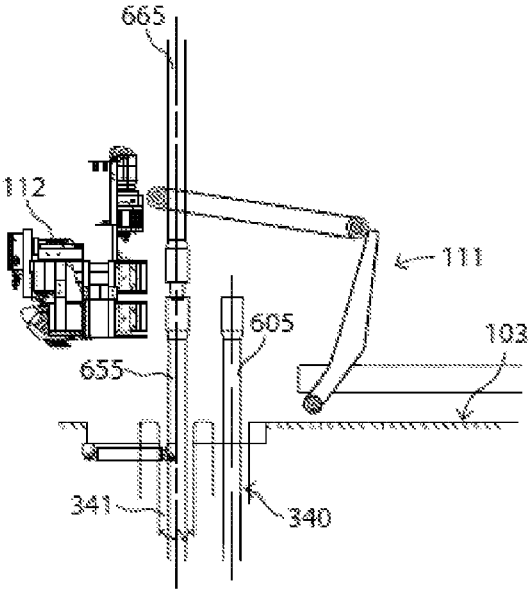
Figure 6F:
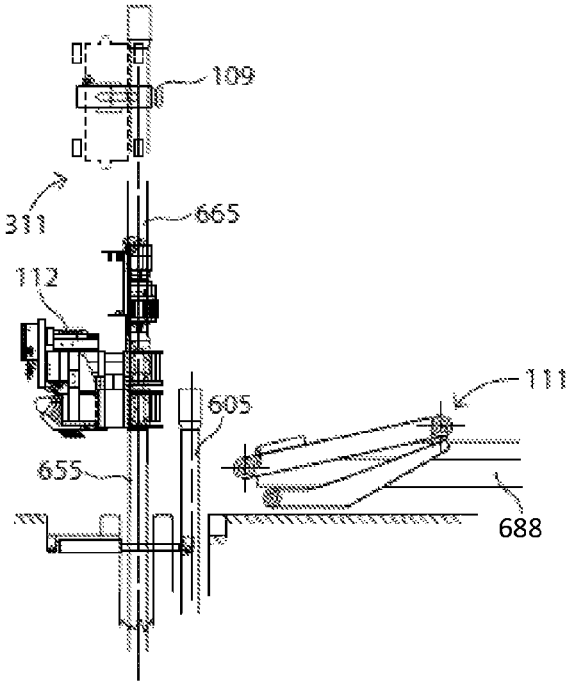
Figure 6G:
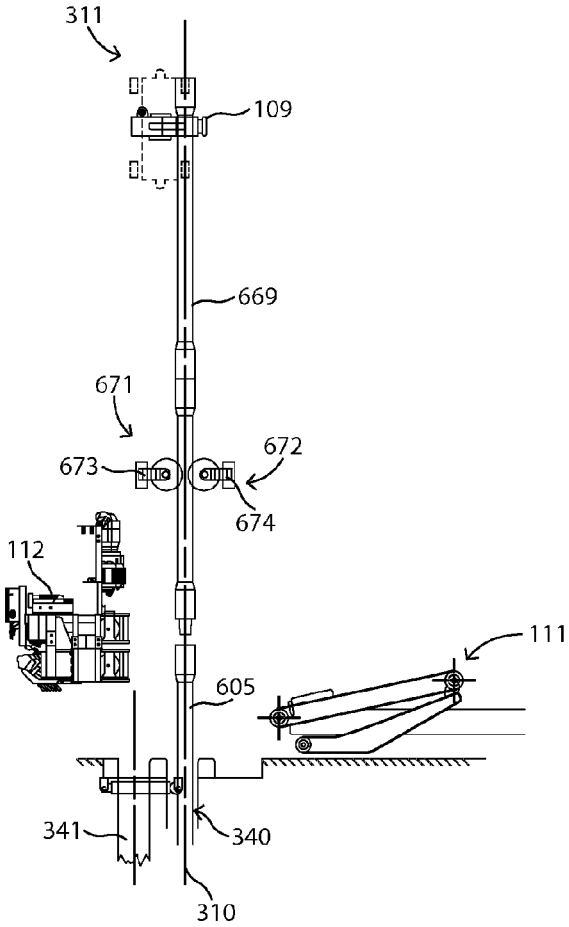
Figure 6H:
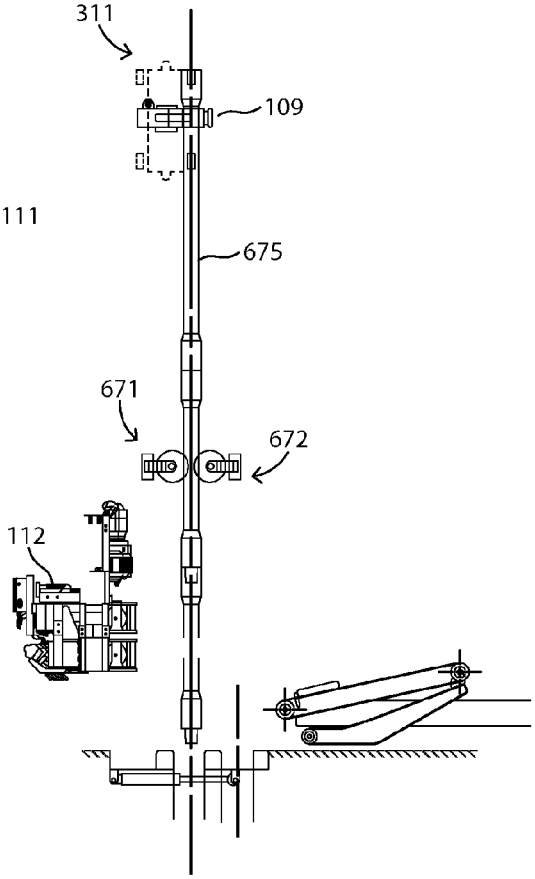
Figure 6I:
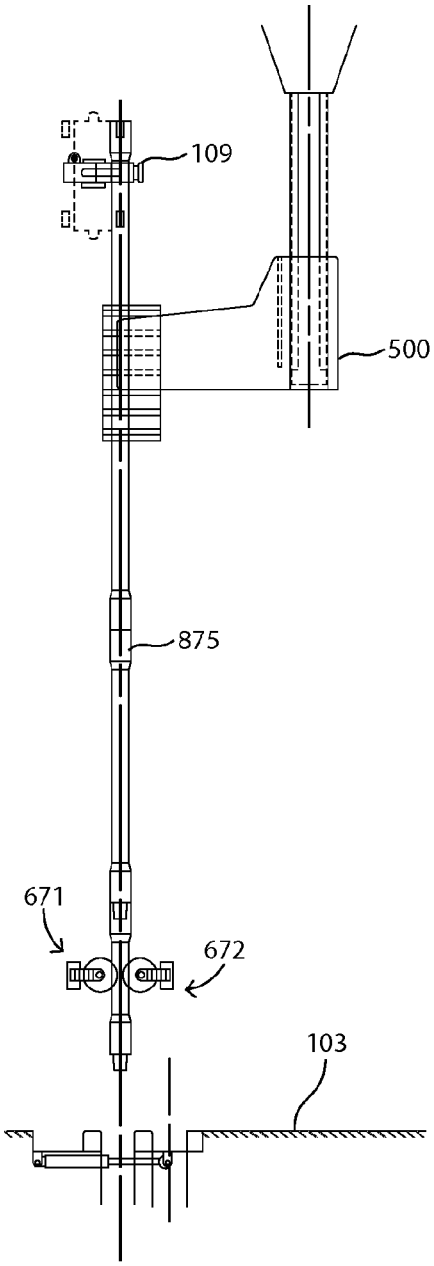

FIGS. 6A-6K provide schematic view illustrations of a sequence for handling tubulars, and in particular, changing a position of a tubular from a substantially horizontal position to a substantially vertical position to facilitate a stand-building operation using the tubular lift system of the embodiments herein. As illustrated, the stabilizer 111 can include a first arm 601 coupled to the shunter 688 through a first hinged axis 606. The stabilizer 111 may also include a second arm 602 coupled to the first arm 601 through a second hinged axis 603. It will be appreciated that the second hinged axis 603 can be parallel to the first hinged axis 606, as generally illustrated in FIGS. 6A-6K. Notably, the second arm 602 can be configured to aciculate independently from the first arm 601 in order to facilitate changing position of the tubular 605 from a substantially horizontal position to a substantially vertical position. FIG. 6A includes a schematic illustration of a first sequence wherein a first tubular 605 is moved to an end of a shunter 688. The first tubular 605 can be moved to the end of the shunter 688 and over a portion of the stabilizer 111. In particular, the first tubular 605 can be moved to the end of the shunter 688 over the stabilizer 111 and over a receiving surface 604 of the stabilizer 111. After the first tubular 605 is moved to the end of shunter 688 and the proximal end region 252 of the first tubular 605 is adjacent to the receiving surface 604, the stabilizer 111 can be moved in a direction 607 by the second arm 602 to provide the first tubular 605 to an initial position 670. It will be appreciated that the second arm 602 can move to provide the first tubular 605 to the initial position 670, while the first arm 601 can remain stationary and in an initial position, as particularly illustrated in FIGS. 6A and 6B.

In the initial position, the proximal end region 252 can be placed at an engagement head axis 310, such that the proximal end region 252 of the first tubular 605 is configured to be engaged by the engagement head 109. Notably, the movement of the stabilizer 111 can be facilitated by at least one hinged axis 603 facilitating motion of the second arm 602 of the stabilizer 111 in the direction 607 and lifting the tubular to the initial position 670. It will be appreciated that in moving the first tubular 605 from the end of the shunter 688 to the initial position 670, wherein the proximal end region 252 is placed on an engagement head axis 310, one or more elements of the pipe pusher 688 may be used to engage and push a distal end of the first tubular 605 over the receiving surface 604 of the stabilizer 111.

FIG. 6B includes a schematic view of a second sequence for operating a tubular lift system in accordance with an embodiment. As illustrated, at the second sequence, the engagement head 109 of the engagement head assembly 311 can be engaged with the proximal end region 252 of the first tubular 605. The engagement head 109 can travel in a vertical direction 396 along the engagement head axis 310 to lift the tubular from the substantially horizontal position of the initial position 670 toward a substantially vertical position. During lifting of the first tubular 605 in the vertical direction 396, the engagement head 109 may be configured to simultaneously rotate in a direction 611 to facilitate the change of position of the first tubular 605 from a substantially horizontal position to a substantially vertical position.

FIG. 6C includes a schematic view illustration of a third sequence for operating a tubular lift system in accordance with an embodiment. As illustrated, the first tubular 605 can be lifted by the engagement head 109 along the engagement head axis 310. Furthermore, during vertical lifting of the first tubular 605, the stabilizer 111 can maintain contact with a distal end region 262 of the first tubular 605 to limit and substantially eliminate uncontrolled motion of the distal end region 262 of the first tubular 605 during a change of position from the substantially horizontal position to the substantially vertical position. In order to facilitate maintaining contact of the distal end region 622 of the first tubular 605 with the stabilizer 111, the stabilizer 111 can be configured for movement in a first direction 621, and thereafter, movement in a second direction 622 to facilitate delivery of the tubular to the substantially vertical position with the predetermined vertical axis which may coincide with a central axis 320 of the first mousehole 340. It will be appreciated that movement in the first direction 621 can be provided by the second arm 602 of the stabilizer 111 while the first arm 601 can remain stationary and in an initial position, as generally illustrated. As further illustrated, movement in the second direction 622 can be provided by the first arm 601 of the stabilizer 111 while the second arm 602 can remain stationary. As will be appreciated motion of the stabilizer 111 can be facilitated by one or more drives devices, which may include, for example, a hydraulic device to facilitate motion of the stabilizer 111 in multiple directions.

Figure 7A:
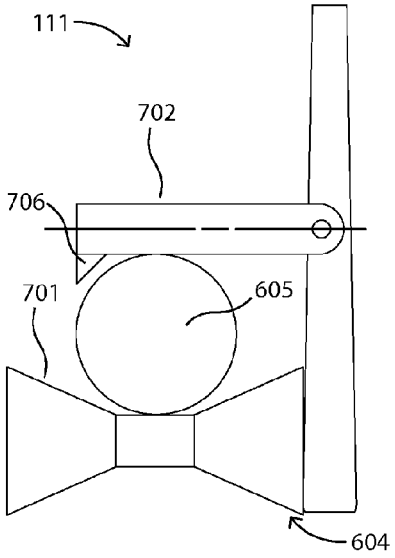
FIG. 7A includes an illustration of a portion of a stabilizer in accordance with an embodiment.
Figure 7B:
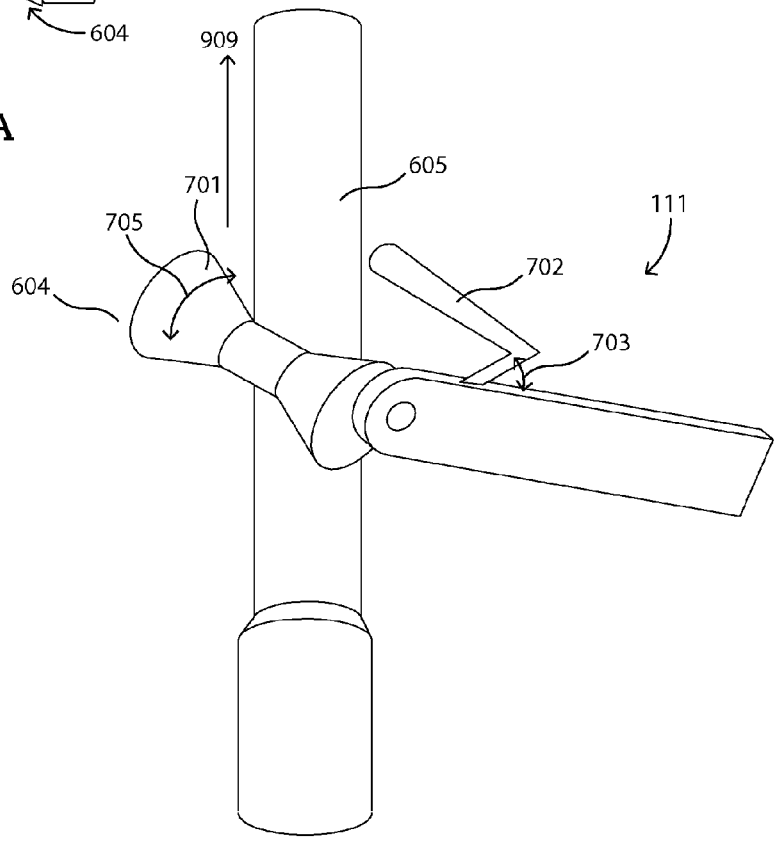
FIG. 7B includes an illustration of a portion of a stabilizer in accordance with an embodiment.

As noted herein, the stabilizer 111 can have particular features that may be utilized to properly position the distal end region 262 of the first tubular 605 on the stabilizer 111 and maintain control of the distal end region 262 of the tubular during the change in position of the first tubular 605 from the substantially horizontal position to the substantially vertical position. FIG. 7A includes an illustration of a portion of a stabilizer in accordance with an embodiment. FIG. 7B includes an illustration of a stabilizer engaging a tubular in accordance with an embodiment. The stabilizer 111 can be configured to engage a distal end region 262 of a tubular and reduce uncontrolled motion (e.g., swinging motion) of the distal end region 262 of the first tubular 605, and in particular, can eliminate the need for human interaction with the work zone 131 to stabilize the distal end region 262 of the first tubular 605. In particular instances, the stabilizer 111 can be contained within the work zone 131 and spaced away from an operator zone 132. Accordingly, the stabilizer 111 may be controlled by an operator within the operator zone 132. It will be appreciated that operation of the stabilizer 111 may be a remote-controlled process utilizing any one of the input modules noted above. Alternatively, the stabilizer 111 may be operated as an automated process requiring little to no continual input from an operator to conduct operations, and rather, may be operated by actuation of a single switch.

In accordance with an embodiment, the stabilizer 111 can be configured to engage at least a portion of the first tubular 605 in the substantially horizontal position and facilitate movement of the first tubular 605 to the initial position 670. Moreover, as noted in FIG. 6C, the stabilizer 111 can be configured for movement in one direction along, including for example, the vertical direction 396, the lateral direction 398, or the horizontal direction 397, and any combination thereof. In particular instances, the stabilizer 111 can be configured for complex movement in at least two directions. The stabilizer 111 may be capable of simultaneous movement in multiple directions. For example, the stabilizer 111 may be configured for movement in the direction 621 and the direction 622 to facilitate lifting and translation of the first tubular 605 in concert with the lifting and rotating motion of the engagement head 109.

According to one aspect, the stabilizer 111 can include a receiving surface 701 configured to engage at least a portion of a first tubular 605. In particular instances, the receiving surface 701 can include a contour having a complementary shape relative to a shape or a portion of a shape of the first tubular 605. For example, the receiving surface 701 may have an arcuate contour configured to engage at least a portion of an exterior surface of the first tubular 605. In more particular instances, the receiving surface 701 of the stabilizer 111 may have a substantially concave curvature to engage at least a portion of the exterior surface of the first tubular 605 therein.

In another aspect, at least a portion of the stabilizer 111 may include a roller 604 configured to rotate in the direction 705 as the tubular translates in a direction 709 over a surface of the roller. For example, the roller 604 can include the receiving surface 701 configured to engage a portion of the first tubular 605, such that upon translation of the tubular over the receiving surface the roller 604 can be configured to rotate and smoothly translate the first tubular 605 over the receiving surface 701.

In at least one embodiment, the stabilizer 111 can further include a stop bar 702. The stop bar 702 can be configured to engage a portion of the tubular and maintain contact between the first tubular 605 and the receiving surface 701 of the stabilizer 111, and reduce swinging motion of the first tubular 605 away from the receiving surface 701 of the stabilizer 111. In particular instances, the first tubular 605 may be disposed between a stop bar 702 and the receiving surface 701 of the stabilizer 111 to reduce uncontrolled motion of a distal end region 262 of the first tubular 605 during a change of position of the tubular from a substantial horizontal position to a substantial vertical position. In at least one embodiment, the stop bar 702 of the stabilizer 111 can include a latch that may be actuated by a switch. The switch can be actuated by a sensor configured to detect the presence and location of the first tubular 605 on the stabilizer 111. Alternatively, the switch can be remote-controlled by an operator in the operator zone 132.

It will be appreciated that in certain instances the stop bar 702 can be configured to be actuated between an open position and a closed position, generally in the direction 703. In the open position, the stop bar 702 can be spaced away from a surface of the first tubular 605, and in the closed position, such as shown in FIGS. 7A and 7B, the stop bar 702 can be configured to be in contact with a surface of the first tubular 605. Accordingly, in the closed position the stop bar 702 may be in contact with the surface of the first tubular 605 and the first tubular 605 may be disposed between a surface of the stop bar 702 and a surface of the receiving surface 901 of the stabilizer 111.

As further illustrated, in one embodiment, the stop bar 702 may include a tab 706 extending from a distal end of the stop bar 702 and configured to facilitate engagement of the first tubular 605 with the receiving surface 701. In one embodiment, the tab 706 can be configured for maintaining the position of the first tubular 605 with the receiving surface 701.

In at least one embodiment, during the motion of the stabilizer in direction 621 and/or 622 the stop bar 702 may be utilized to dispose the proximal end region 262 of the first tubular 605 between the stop bar 702 and receiving surface 701 of the stabilizer 111 to facilitate a smooth transition of the first tubular 605 from a substantially horizontal position to a substantially vertical position and a stabilized state such that the angular variation of the tubular with respect to the predetermined vertical axis is limited.

In accordance with one embodiment, during the change of position of the first tubular 605 from a substantially horizontal position to a substantially vertical position a rotational motion of the engagement head 109 and a motion of the stabilizer 111 in one or more directions can be coordinated relative to each other to limit the uncontrolled motion (e.g., swinging of the distal end region 262 of the tubular). For example, in one embodiment during the change of position of the first tubular 605 from a substantially horizontal position to a substantially vertical position, a vertical motion of the engagement head 109 and motion of the stabilizer 111 can be coordinated relative to each other to limit uncontrolled motion of the first tubular 605. For example, the rate of vertical lift in the direction 396 of the engagement head 109 may be coordinated with the rate of change in direction of the stabilizer in the direction 621 and/or 622 to limit uncontrolled motion of the distal end region 262 of the first tubular 605. Furthermore, it will be appreciate that in addition, the rotational motion of the engagement head 109 in the direction 811 may be controlled relative to the motion of the stabilizer 111 in direction 621 and/or 622 to limit uncontrolled motion of the distal end region 262 of the first tubular 605. For example, the rate of rotation may be managed with respect to the rate of the change direction of the stabilizer 111 in the direction 621 and/or 622.

In one embodiment, a method of managing and controlling the rate of movement in one or more directions between the engagement head 109 and stabilizer 111 can include one or more sensors configured to measure the rate of movement of the engagement head 109 and/or stabilizer 111. Furthermore, the system may utilize one or more logic circuits to adapt the rate of movement of the engagement head 109 and stabilizer 111 with respect to each other based on the measured rates of movement by the sensors. The system may be configured to change the rate of movement of the engagement head 109 and/or stabilizer 111 relative to each other to facilitate a smooth transition and limit uncontrolled motion of the distal end of the first tubular 605 during the change in position of the first tubular 605 from the substantially horizontal position to the substantially vertical position. As further illustrated in FIG. 6C, after placing the first tubular 605 in a substantially vertical position 625, wherein the longitudinal axis of the first tubular 605 is substantially aligned with a predetermined vertical axis corresponding to a central axis 320 of the first mousehole 340, the first tubular 605 may be translated vertically downward in direction 626 to place the first tubular 605 in the first mousehole 340. After securing the first tubular 605 in the first mousehole 340, the components including the engagement head 109 and stabilizer 111, may return to the starting positions as shown in FIG. 6A.

FIG. 6D includes a schematic illustration of a fourth sequence for operating a tubular lift system in accordance with an embodiment. Notably, FIG. 6D is substantially similar to FIG. 6A, however a portion of the mousehole assembly 113 has changed position relative to the position illustrated in FIG. 6A. Notably, the mousehole assembly 113 has engaged a drive device 608 to shift a position of the first mousehole 340 and second mousehole 341 relative to the position of the engagement head 109 and the engagement head axis 310. More particularly, the second mousehole 341 has a central axis 330 that is aligned with a predetermined vertical axis to facilitate delivery of a second tubular 655 to the second mousehole 341.

The second tubular 655 can be delivered to the second mousehole 341 using the same sequence of processes used to deliver the first tubular 605 to the first mousehole 340 as illustrated in FIG. 6A-6C.

FIG. 6E includes a schematic illustration of a fifth sequence for operating a tubular lift system in accordance with an embodiment. As illustrated, a third tubular 665 is provided in a substantially vertical position and aligned with the second tubular 655 in accordance with an embodiment. The movement of the third tubular 665 can be completed using the same sequence of processes as provided in FIGS. 6A-6C. As illustrated in FIG. 6E the third tubular 665 can have a longitudinal axis aligned with the longitudinal axis of the second tubular 655. Furthermore, it will be appreciated that a second rabbit associated with the second mousehole 341 may be actuated to adjust the exposure length of the second tubular 655 such that the second tubular 655 is at a suitable height above the drill floor 103 to facilitate use of the iron roughneck 112.

FIG. 6F includes a schematic illustration of a sixth sequence for operating a tubular lift system in accordance with an embodiment. As illustrated, after aligning the third tubular 665 and the second tubular 655 with each other, the tubulars 665 and 655 may be joined together using an iron roughneck 112. Notably, the third tubular 665 may be maintained in a stabilized state during the joining via the engagement head 109.

FIG. 6G includes a schematic illustration of a seventh sequence for operating a tubular lift system in accordance with an embodiment. As illustrated, third tubular 665 and the second tubular 655 have been joined to form a double 669. After joining the third tubular 665 with the second tubular 655 to form the double 669, the engagement head 109 may lift the double 669 from the second mousehole 341 and align it with the first tubular 605 in the first mousehole 340.

Notably, during the lifting of the double 669 from the second mousehole 341 a portion of the mousehole assembly 113 may change position to facilitate aligning the longitudinal axis of double 669 with the longitudinal axis of the first tubular 605 and the central axis 320 of the first mousehole 340. Alignment between the double 669 and the first tubular 605 can facilitate joining of the double 869 with the first tubular 605. As such, at least a portion of the mousehole assembly 113 may be returned to an original position as illustrated in FIG. 6A.

As further illustrated, the system can include one of more alignment elements 671 and 672 configured to engage a portion of the double 669 or one or the tubulars of the double 669 to facilitate maintaining a desired stabilized state and low angular variation with respect to a predetermined vertical axis. The use of the alignment elements 671 and 672 can facilitate maintaining a small angular variation of the tubular with respect to the predetermined vertical axis during translation of the tubular along the predetermined vertical axis.

In at least one embodiment, the alignment element 671 can include a roller configured to rotate in response to translation of the tubular over a surface of the roller. It will be appreciated that the system may utilize more than one alignment element, and particularly more than one alignment element in the form or rollers, such as illustrated in FIG. 6G. For example, in at least one embodiment, the tubular (e.g., the double 669) may be disposed between two or more alignment elements 671 and 672 in the form of rollers configured to maintain the substantially vertical position of the tubular and furthermore provide a stabilized state to the tubular while it is being translated along the predetermined vertical axis and delivered to the mousehole assembly 113. Moreover, in one embodiment, the alignment element 671 can include a dampening member 673, such as a spring, configured to absorb shocks and dampen forces that could be transferred to the tubular and cause misalignment between the tubular and the predetermined vertical axis. As further illustrated, the alignment element 672 may also include a dampening member 674, such as a spring configured to absorb shocks and dampen forces that could be transferred to the tubular and cause misalignment between the tubular and the predetermined vertical axis.

In certain instances, at least one of the alignment elements 671 and 672 may be movable between a first position and a second position. For example, in the first position the alignment element 671 and/or 672 may be disengaged with the surface of the tubular (i.e., the double 669) such that there is distance between the surface of the alignment element and an exterior surface of the tubular, as shown, for example in FIG. 6J. However, in a second position, the alignment element 871 and/or 872 may be moved into contact with the exterior surface of the tubular to engage and maintain the position of the tubular in the substantially vertical position.

FIG. 6H includes a schematic illustration of an eighth sequence for operating a tubular lift system in accordance with an embodiment. As illustrated, the process can include joining of the double 669 with the first tubular 605 in the first mousehole 340 to form a stand 675. The process can further include initiating the removal of the stand 675 from the first mousehole 340 by translation of the engagement head 109 in the vertical direction 396 to lift the stand 675 from the mousehole assembly 113.

FIG. 6I includes a schematic illustration of a ninth sequence for operating a tubular lift system in accordance with an embodiment. In particular, the ninth sequence can include use of a griphead 500 configured to engage a portion of the stand 675 from the engagement head 109. The griphead 500 may be configured to engage the stand 675 and facilitate lifting the stand 675 in the vertical direction 396 to a storage location above the drill floor 103.

Figure 6J:
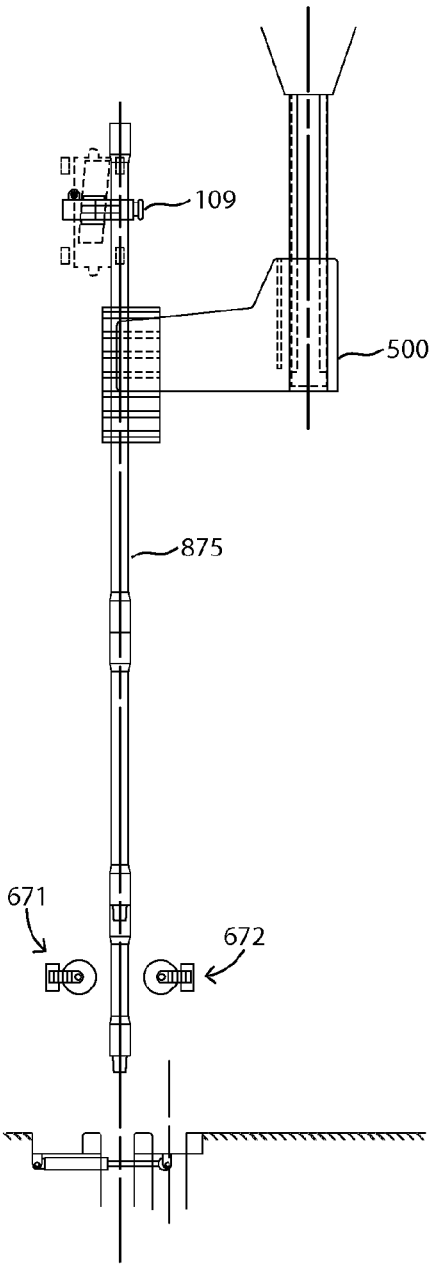

FIG. 6J includes a schematic illustration of a tenth sequence for forming a stand of tubulars in accordance with an embodiment. In particular, the tenth sequence can include disengagement of the alignment elements 671 and 672 from the stand 675 after the griphead 500 has securely engaged and grasped the stand 675.

Figure 6K:
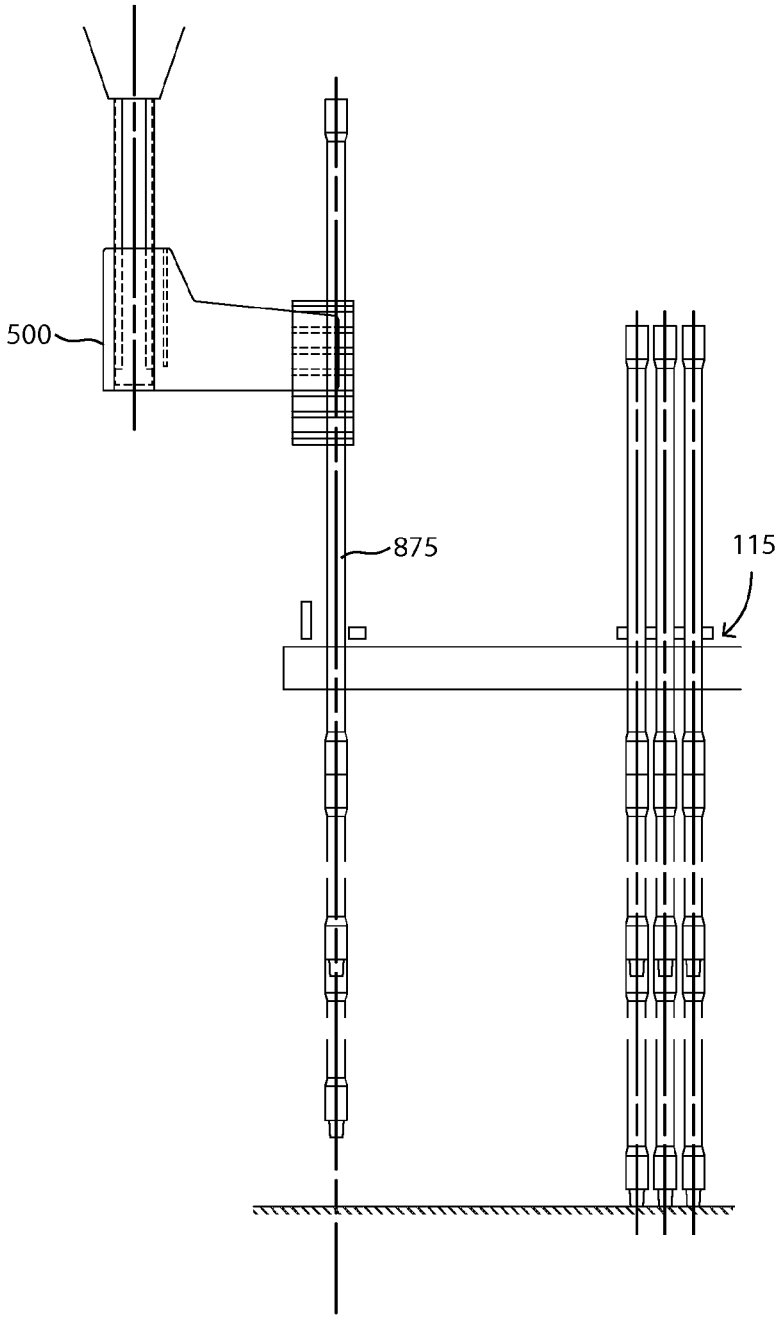

FIG. 6K includes a schematic illustration of an eleventh sequence for forming a stand of tubulars in accordance with an embodiment. In particular, the eleventh sequence can include translation of the stand 675 by the griphead 500 to a racker 115, which may be a storage location for the stand 675 prior to the stand being transported to the well center 188 to be deployed in the drilling operation.

It will be appreciated that the griphead 500 may facilitate direct delivery of the stand to the well center 188 for incorporation into the drilling operation. Any of the components and systems described herein can be remotely operated by an operator positioned outside of the work zone 131 as described herein. Moreover, any of the components, systems, or processes herein can be automated and configured to conduct one or more functions by actuation of a single switch. It will also be appreciated that a fewer or greater number of sequences may be used in the process of stand-building. Alternative sequences and combinations of processes or components may be utilized without deviating from the embodiments herein.

In at least one embodiment, the process of building a stand of tubulars including at least three tubular joined together can be completed in an average stand-building time that is at least about 10% less than an average stand-building time of conventional equipment.

The embodiments of the present application represent a departure from the state of the art. Notably, the embodiments herein demonstrate a new combination of components, systems, and processes facilitating improved manipulation of tubulars in stand-building operations, particularly on jack-up rigs and other platforms having limited space. Unlike prior art methods of manipulating tubulars that rely on heavy, large, and expensive HTV arms, which have known limits with respect to manipulating a tubular with low angular variation the present embodiments have clear advantages in terms of safety, weight, cost, speed, and size. Moreover, in comparison to conventional systems utilizing roughnecks or direct-operated (i.e., manned) tools to secure swinging tubulars, the embodiments herein include a combination of features that facilitate safe and efficient handling of tubulars. The combination of features can include, but is not limited to, the features of the engagement head, the features of the stabilizer, the features of the alignment elements, the features of the mousehole assembly, and the combination of the features working in concert.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the scintillation and radiation detection arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A system for manipulating tubulars for subterranean operations comprising:

a remote-controlled tubular lift system (RCTLS) comprising:

an engagement head configured to grasp a proximal end region of a tubular and change the position of the tubular from a substantially horizontal position to a substantially vertical position; and a stabilizer configured to initially engage the tubular at the proximal end region of the tubular and limit swinging motion of the tubular as it translates over the stabilizer during the change of the position of the tubular from the substantially horizontal position to the substantially vertical position, wherein the stabilizer comprises:

a first arm coupled to a shunter through a first hinged axis;

a second arm coupled to the first arm through a second hinged axis, the second hinged axis being parallel to the first hinged axis; and wherein the second arm is configured to articulate independently from the first arm.

2. The system of claim 1, further comprising a work zone, wherein the engagement head is contained within the work zone.

3. The system of claim 1, wherein the proximal end region is spaced away from a center of gravity of the tubular by at least about 0.2(l), wherein l is a length of the tubular.

4. The system of claim 1, wherein the tubular is selected from the group of tubulars consisting of drillpipe, casing, drillcollar, and a combination thereof.

5. The system of claim 1, wherein the RCTLS is part of a rig.

6. The system of claim 1, wherein the engagement head is part of an engagement head assembly comprising the engagement head coupled to an engagement head tower, and wherein the engagement head is configured to simultaneously translate along an engagement head axis and rotate about a rotational axis to change the position of the tubular from a substantially horizontal position to a substantially vertical position.

7. The system of claim 1, wherein the engagement head is part of an engagement head assembly comprising the engagement head coupled to an engagement head tower, and wherein the engagement head is configured to translate the tubular in a vertical position along the predetermined vertical axis and maintain an angular variation of not greater than about 5 degrees during translation.

8. The system of claim 1, wherein in the vertical position a longitudinal axis of the tubular has an angular variation with respect to a predetermined vertical axis of not greater than about 5 degrees.

9. The system of claim 1, wherein the stabilizer is configured to engage at least a portion of the tubular in the substantially horizontal position, and is configured to move the tubular to a ready position to be engaged with the engagement head.

10. The system of claim 1, wherein the stabilizer is configured to engage a portion of the tubular and guide a distal end of the tubular during the change of position of the tubular from the substantially horizontal position to the substantially vertical position.

11. The system of claim 1, wherein the stabilizer is configured for movement along at least a vertical axis, a lateral axis, a horizontal axis, or a combination thereof.

12. The system of claim 1, wherein the stabilizer comprises a receiving surface configured to engage at least a portion of the tubular, and wherein the receiving surface comprises a contour having a complementary shape to at least a portion of the exterior surface of the tubular.

13. The system of claim 1, wherein the stabilizer comprises a roller configured to rotate as the tubular translates over a surface of the roller.

14. The system of claim 13, wherein the roller comprises a receiving surface configured to engage at least a portion of the tubular.

15. The system of claim 1, wherein the stabilizer further comprises a stop bar configured to engage a portion of the tubular and maintain contact between the tubular and a receiving surface of the stabilizer.

16. The system of claim 1, further comprising at least one alignment element configured to engage a portion of the tubular in the vertical position and assist in maintaining the angular variation of not greater than about 5 degrees during translation of the tubular along the predetermined vertical axis.

17. The system of claim 1, wherein the stabilizer is configured to engage a distal end region of the tubular opposite the proximal end region, wherein the distal end region is spaced away from a center of gravity of the tubular by at least about 0.2(l).

18. The system of claim 1, wherein the engagement head is configured to translate vertically along an engagement head axis substantially parallel to the predetermined vertical axis to change the position of the tubular from the substantially horizontal position to the substantially vertical position.

19. The system of claim 1, wherein the stabilizer is configured for simultaneous movement in multiple directions.

20. The system of claim 1, wherein the stabilizer is configured for complex movement in at least two directions.

* * * * *